US010727609B2

(12) United States Patent
Chen et al.

(10) Patent No.: US 10,727,609 B2
(45) Date of Patent: Jul. 28, 2020

(54) SURFACE SCATTERING ANTENNAS WITH LUMPED ELEMENTS

(71) Applicant: Searete LLC, Bellevue, WA (US)

(72) Inventors: Pai-Yen Chen, Houston, TX (US); Tom Driscoll, San Diego, CA (US); Siamak Ebadi, Redmond, WA (US); John Desmond Hunt, Seattle, WA (US); Nathan Ingle Landy, Seattle, WA (US); Melroy Machado, Seattle, WA (US); Jay Howard McCandless, Alpine, CA (US); Milton Perque, Jr., Seattle, WA (US); David R. Smith, Durham, NC (US); Yaroslav A. Urzhumov, Bellevue, WA (US)

(73) Assignee: The Invention Science Fund I, LLC, Bellevue, WA (US)

( * ) Notice: Subject to any disclaimer, the term of this patent is extended or adjusted under 35 U.S.C. 154(b) by 143 days.

(21) Appl. No.: 15/825,565

(22) Filed: Nov. 29, 2017

(65) Prior Publication Data

US 2018/0159245 A1 Jun. 7, 2018

Related U.S. Application Data

(63) Continuation of application No. 14/506,432, filed on Oct. 3, 2014, now Pat. No. 9,853,361.
(Continued)

(51) Int. Cl.
*H01Q 9/00* (2006.01)
*H01Q 21/00* (2006.01)
(Continued)

(52) U.S. Cl.
CPC ..... *H01Q 21/005* (2013.01); *H01P 7/082* (2013.01); *H01Q 3/443* (2013.01); *H01Q 9/0442* (2013.01); *H01Q 9/0407* (2013.01); *H01Q 13/20* (2013.01)

(58) Field of Classification Search
CPC .... H01Q 21/005; H01Q 3/443; H01Q 9/0442; H01Q 9/0407; H01Q 13/20; H01P 7/082
See application file for complete search history.

(56) References Cited

U.S. PATENT DOCUMENTS 3,001,193 A 9/1961 Marie
3,388,396 A 6/1968 Rope et al.
(Continued)

FOREIGN PATENT DOCUMENTS

CN 103222109 A 7/2013
JP 52-13751 A 2/1977
(Continued)

OTHER PUBLICATIONS

Mikulasek et al, "2x2 Microstrip Patch Antenna Array Fed by Substrate Integrated Waveguide for Radar Applications", IEEE Antenna and Wireless Propagation Letters, vol. 12, 2013, pp. 1287-1290 (Year: 2013).*
(Continued)

*Primary Examiner* — Dieu Hien T Duong

(57) ABSTRACT

Surface scattering antennas with lumped elements provide adjustable radiation fields by adjustably coupling scattering elements along a wave-propagating structure. In some approaches, the surface scattering antenna is a multi-layer printed circuit board assembly, and the lumped elements are surface-mount components placed on an upper surface of the printed circuit board assembly. In some approaches, the scattering elements are adjusted by adjusting bias voltages
(Continued)

for the lumped elements. In some approaches, the lumped elements include diodes or transistors.

10 Claims, 15 Drawing Sheets

Related U.S. Application Data

(60) Provisional application No. 61/988,023, filed on May 2, 2014.

(51) Int. Cl.

| | |
|---|---|
| ***H01Q 9/04*** | (2006.01) |
| ***H01P 7/08*** | (2006.01) |
| ***H01Q 3/44*** | (2006.01) |
| *H01Q 13/20* | (2006.01) |

(56) References Cited

U.S. PATENT DOCUMENTS

| | | | |
|---|---|---|---|
| 3,604,012 | A | 9/1971 | Lindley |
| 3,714,608 | A | 1/1973 | Barnes et al. |
| 3,757,332 | A | 9/1973 | Tricoles |
| 3,887,923 | A | 6/1975 | Hendrix |
| 4,195,262 | A | 3/1980 | King |
| 4,229,745 | A | 10/1980 | Kruger |
| 4,291,312 | A | 9/1981 | Kaloi |
| 4,305,153 | A | 12/1981 | King |
| 4,489,325 | A | 12/1984 | Bauck et al. |
| 4,509,209 | A | 4/1985 | Itoh et al. |
| 4,672,378 | A | 6/1987 | Drabowitch et al. |
| 4,701,762 | A | 10/1987 | Apostolos |
| 4,780,724 | A | 10/1988 | Sharma et al. |
| 4,832,429 | A | 5/1989 | Nagler |
| 4,874,461 | A | 10/1989 | Sato et al. |
| 4,920,350 | A | 4/1990 | McGuire et al. |
| 4,947,176 | A | 8/1990 | Inatsune et al. |
| 4,978,934 | A | 12/1990 | Saad |
| 5,198,827 | A | 3/1993 | Seaton |
| 5,455,590 | A | 10/1995 | Collins et al. |
| 5,512,906 | A | 4/1996 | Speciale |
| 5,734,347 | A | 3/1998 | McEligot |
| 5,841,543 | A | 11/1998 | Guldi et al. |
| 5,889,599 | A | 3/1999 | Takemori |
| 6,031,506 | A | 2/2000 | Cooley et al. |
| 6,061,023 | A | 5/2000 | Daniel et al. |
| 6,061,025 | A | 5/2000 | Jackson et al. |
| 6,075,483 | A | 6/2000 | Gross |
| 6,084,540 | A | 7/2000 | Yu |
| 6,114,834 | A | 9/2000 | Parise |
| 6,166,690 | A | 12/2000 | Lin et al. |
| 6,198,453 | B1 | 3/2001 | Chew |
| 6,211,823 | B1 | 4/2001 | Herring |
| 6,232,931 | B1 | 5/2001 | Hart |
| 6,236,375 | B1 | 5/2001 | Chandler et al. |
| 6,275,181 | B1 | 8/2001 | Kitayoshi |
| 6,366,254 | B1 | 4/2002 | Sievenpiper et al. |
| 6,384,797 | B1 | 5/2002 | Schaffner et al. |
| 6,396,440 | B1 | 5/2002 | Chen |
| 6,469,672 | B1 | 10/2002 | Marti-Canales et al. |
| 6,545,645 | B1 | 4/2003 | Wu |
| 6,552,696 | B1 | 4/2003 | Sievenpiper et al. |
| 6,633,026 | B2 | 10/2003 | Tuominen |
| 6,985,107 | B2 | 1/2006 | Anson et al. |
| 7,068,234 | B2 | 6/2006 | Sievenpiper |
| 7,151,499 | B2 | 12/2006 | Avakian et al. |
| 7,154,451 | B1 | 12/2006 | Sievenpiper |
| 7,253,780 | B2 | 8/2007 | Sievenpiper |
| 7,295,146 | B2 | 11/2007 | McMakin et al. |
| 7,307,596 | B1 | 12/2007 | West |
| 7,339,521 | B2 | 3/2008 | Scheidemann et al. |
| 7,428,230 | B2 | 9/2008 | Park |
| 7,456,787 | B2 | 11/2008 | Manasson et al. |
| 7,609,223 | B2 | 10/2009 | Manasson et al. |
| 7,667,660 | B2 | 2/2010 | Manasson et al. |
| 7,830,310 | B1 | 11/2010 | Sievenpiper et al. |
| 7,834,795 | B1 | 11/2010 | Dudgeon et al. |
| 7,864,112 | B2 | 1/2011 | Manasson et al. |
| 7,911,407 | B1 | 3/2011 | Fong et al. |
| 7,929,147 | B1 | 4/2011 | Fong et al. |
| 7,995,000 | B2 | 8/2011 | Manasson et al. |
| 8,009,116 | B2 | 8/2011 | Peichl et al. |
| 8,014,050 | B2 | 9/2011 | McGrew |
| 8,040,586 | B2 | 10/2011 | Smith et al. |
| 8,059,051 | B2 | 11/2011 | Manasson et al. |
| 8,134,521 | B2 | 3/2012 | Herz et al. |
| 8,179,331 | B1 | 5/2012 | Sievenpiper |
| 8,212,739 | B2 | 7/2012 | Sievenpiper |
| 8,339,320 | B2 | 12/2012 | Sievenpiper |
| 8,456,360 | B2 | 6/2013 | Manasson et al. |
| 9,231,303 | B2 | 1/2016 | Edelmann et al. |
| 9,268,016 | B2 | 2/2016 | Smith et al. |
| 9,389,305 | B2 | 7/2016 | Boufounos |
| 9,634,736 | B2 | 4/2017 | Mukheriee et al. |
| 2002/0039083 | A1 | 4/2002 | Taylor et al. |
| 2002/0167456 | A1 | 11/2002 | McKinzie, III |
| 2003/0214443 | A1 | 11/2003 | Bauregger et al. |
| 2004/0227668 | A1 | 11/2004 | Sievenpiper |
| 2004/0263408 | A1 | 12/2004 | Sievenpiper et al. |
| 2005/0031016 | A1 | 2/2005 | Rosen |
| 2005/0031295 | A1 | 2/2005 | Engheta et al. |
| 2005/0041746 | A1 | 2/2005 | Rosen et al. |
| 2005/0088338 | A1 | 4/2005 | Masenten et al. |
| 2006/0065856 | A1 | 3/2006 | Diaz et al. |
| 2006/0114170 | A1 | 6/2006 | Sievenpiper |
| 2006/0116097 | A1 | 6/2006 | Thompson |
| 2006/0132369 | A1 | 6/2006 | Robertson et al. |
| 2006/0187126 | A1 | 8/2006 | Sievenpiper |
| 2007/0085757 | A1 | 4/2007 | Sievenpiper |
| 2007/0103381 | A1 | 5/2007 | Upton |
| 2007/0159395 | A1 | 7/2007 | Sievenpiper et al. |
| 2007/0159396 | A1 | 7/2007 | Sievenpiper et al. |
| 2007/0182639 | A1 | 8/2007 | Sievenpiper et al. |
| 2007/0200781 | A1 | 8/2007 | Ahn et al. |
| 2007/0229357 | A1 | 10/2007 | Zhang et al. |
| 2008/0020231 | A1 | 1/2008 | Yamada et al. |
| 2008/0165079 | A1 | 7/2008 | Smith et al. |
| 2008/0180339 | A1 | 7/2008 | Yagi |
| 2008/0224707 | A1 | 9/2008 | Wisler et al. |
| 2008/0259826 | A1 | 10/2008 | Stmhsaker |
| 2008/0268790 | A1 | 10/2008 | Shi et al. |
| 2008/0316088 | A1 | 12/2008 | Pavlov et al. |
| 2009/0002240 | A1 | 1/2009 | Sievenpiper et al. |
| 2009/0045772 | A1 | 2/2009 | Cook et al. |
| 2009/0109121 | A1 | 4/2009 | Herz et al. |
| 2009/0147653 | A1 | 6/2009 | Waldman et al. |
| 2009/0195361 | A1 | 8/2009 | Smith |
| 2009/0251385 | A1 | 10/2009 | Xu et al. |
| 2010/0066629 | A1 | 3/2010 | Sievenpiper |
| 2010/0073261 | A1 | 3/2010 | Sievenpiper |
| 2010/0079010 | A1 | 4/2010 | Hyde et al. |
| 2010/0109972 | A2 | 5/2010 | Xu et al. |
| 2010/0134370 | A1 | 6/2010 | Oh et al. |
| 2010/0156573 | A1 | 6/2010 | Smith et al. |
| 2010/0157929 | A1 | 6/2010 | Karabinis |
| 2010/0188171 | A1 | 7/2010 | Mohaier-Iravani et al. |
| 2010/0238529 | A1 | 9/2010 | Sampsell et al. |
| 2010/0279751 | A1 | 11/2010 | Pourseyed et al. |
| 2010/0328142 | A1 | 12/2010 | Zoughi et al. |
| 2011/0098033 | A1 | 4/2011 | Britz et al. |
| 2011/0117836 | A1 | 5/2011 | Zhang et al. |
| 2011/0128714 | A1 | 6/2011 | Terao et al. |
| 2011/0151789 | A1 | 6/2011 | Viglione et al. |
| 2011/0267664 | A1 | 11/2011 | Kitamura et al. |
| 2012/0026068 | A1 | 2/2012 | Sievenpiper |
| 2012/0038317 | A1 | 2/2012 | Miyamoto et al. |
| 2012/0112543 | A1 | 5/2012 | vanWageningen et al. |
| 2012/0194399 | A1 | 8/2012 | Bily et al. |
| 2012/0219249 | A1 | 8/2012 | Pitwon |
| 2012/0268340 | A1 | 10/2012 | Capozzoli et al. |
| 2012/0274147 | A1 | 11/2012 | Stecher et al. |
| 2012/0280770 | A1* | 11/2012 | Abhari ..... H01P 1/184 333/209 |

(56) References Cited

U.S. PATENT DOCUMENTS

| | | | |
|---|---|---|---|
| 2012/0326660 | A1 | 12/2012 | Lu et al. |
| 2013/0069865 | A1 | 3/2013 | Hart |
| 2013/0082890 | A1 | 4/2013 | Wang et al. |
| 2013/0237272 | A1 | 9/2013 | Prasad |
| 2013/0249310 | A1 | 9/2013 | Hyde et al. |
| 2013/0278211 | A1 | 10/2013 | Cook et al. |
| 2013/0288617 | A1 | 10/2013 | Kim et al. |
| 2013/0343208 | A1 | 12/2013 | Sexton et al. |
| 2014/0128006 | A1 | 5/2014 | Hu |
| 2014/0217269 | A1 | 8/2014 | Guo et al. |
| 2014/0266946 | A1 | 9/2014 | Bily et al. |
| 2015/0280444 | A1 | 10/2015 | Smith et al. |
| 2017/0098961 | A1 | 4/2017 | Harpham |

FOREIGN PATENT DOCUMENTS

| | | | |
|---|---|---|---|
| JP | 2007-081825 | A | 3/2007 |
| JP | 2008-054146 | A | 3/2008 |
| JP | 2010-187141 | A | 8/2010 |
| KR | 10-1045585 | B1 | 6/2011 |
| WO | WO 01/73891 | A1 | 10/2001 |
| WO | WO 2008-007545 | A1 | 1/2008 |
| WO | WO 2008/059292 | A2 | 5/2008 |
| WO | WO 2009/103042 | A2 | 8/2009 |
| WO | WO 2010/0021736 | | 2/2010 |
| WO | PCT/US2013/212504 | | 5/2013 |
| WO | WO 2013/147470 | A1 | 10/2013 |

OTHER PUBLICATIONS

Cheon et al., "Stripline-fed aperture-coupled patch array antenna with reduced sidelobe", Electronics Letters Sep. 3, 2015 vol. 51 No. 18 pp. 1402-1403 (Year: 2015).*

European Patent Office, Communication Pursuant to Article 94(3) EPC; App. No. EP 15808884.9; dated Oct. 17, 2019; pp. 1-6.

European Patent Office, Communication Pursuant to Article 94(3) EPC; App. No. EP 15786329.1; dated Oct. 17, 2019; pp. 1-6.

Chinese State Intellectual Property Office, First Office Action, App. No. 2015/80036356.3 (based on PCT Patent Application No. PCT/US2015/028781); dated Sep. 5, 2018; machine translation provided, 6 pages total.

European Patent Office, Supplementary European Search Report, Pursuant to Rule 62 EPC; App. No. EP 14891152; dated Jul. 20, 2017; pp. 1-4.

Supplementary European Search Report, Pursuant to Rule 62 EPC; App. No. EP 14 87 2595; dated Jul. 3, 2017; pp. 1-16.

Supplementary European Search Report, Pursuant to Rule 62 EPC; App. No. EP 14 87 2874; dated Jul. 3, 2017; pp. 1-15.

Ayob et al.; "A Survey of Surface Mount Device Placement Machine Optimisation: Machine Classification"; Computer Science Technical Report No. NOTTCS-TR-2005-8; Sep. 2005; pp. 1-34.

"Aperture", Definition of Aperture by Merriam-Webster; located at http://www.merriam-webster.com/dictionary/aperture; printed by Examiner on Nov. 30, 2016; pp. 1-9; Merriam-Webster, Incorporated.

PCT International Preliminary Report on Patentability; International App. No. PCT/US2014/070645, dated Jun. 21, 2016; pp. 1-12.

Canadian Intellectual Property Office, Canadian Examination Search Report, Pursuant to Subsection 30(2); App. No. 2,814,635; dated Dec. 1, 2016; pp. 1-3.

The State Intellectual Property Office of PRC, Fifth Office Action, App. No. 2011/80055705.8 (Based on PCT Patent Application No. PCT/US201 I/001755); dated Nov. 16, 2016; pp. 1-3 (machine translation, as provided).

Extended European Search Report; European App. No. EP 14 77 0686; dated Oct. 14, 2016; pp. 1-7.

European Search Report; European App. No. EP 11 832 873.1; dated Sep. 21, 2016; pp. 1-6.

PCT International Search Report; International App. No. PCT/US2016/037667; dated Sep. 7, 2016; pp. 1-3.

Chinese State Intellectual Property Office, Notification of Fourth Office Action, App. No. 2011/80055705.8 (Based on PCT Patent Application No. PCT/US2011/001755); dated May 20, 2016; pp. 1-4 (machine translation only).

IP Australia Patent Examination Report No. 1; Patent Application No. 2011314378; dated Mar. 4, 2016; pp. 1-4.

Definition from Merriam-Webster Online Dictionary; "Integral"; Merriam-Webster Dictionary; cited and printed by Examiner on Dec. 8, 2015; pp. 1-5; located at: http://www.merriam-webster.com/dictionary/integral.

Varlamos et al.; "Electronic Beam Steering Using Switched Parasitic Smart Antenna Arrays"; Progress in Electromagnetics Research; PIER 36; bearing a date of 2002; pp. 101-119.

The State Intellectual Property Office of P.R.C.; Application No. 201180055705.8; Nov. 4, 2015; pp. 1-11.

PCT International Search Report; International App. No. PCT/US2014/069254; dated Nov. 27, 2015; pp. 1-4.

Patent Office of the Russian Federation (Rospatent) Office Action; Application No. 2013119332/28(028599); dated Oct. 13, 2015; machine translation; pp. 1-5.

PCT International Search Report; International App. No. PCT/US2015/036638; dated Oct. 19, 2015; pp. 1-4.

PCT International Search Report; International App. No. PCT/US2015/028781; dated Jul. 27, 2015; pp. 1-3.

PCT International Search Report; International App. No. PCT/US2014/061485; dated Jul. 27, 2015; pp. 1-3.

Fan, Guo-Xin et al.; "Scattering from a Cylindrically Conformal Slotted Waveguide Array Antenna"; IEEE Transactions on Antennas and Propagation; Jul. 1997; pp. 1150-1159; vol. 45, No. 7; IEEE.

Jiao, Yong-Chang et al.; A New Low-Side-Lobe Pattern Synthesis Technique for Conformal Arrays; IEEE Transactions on Antennas and Propagation; Jun. 1993; pp. 824-831, vol. 41, No. 6; IEEE.

The State Intellectual Property Office of P.R.C.; Application No. 201180055705.8; May 6, 2015; pp. 1-11.

Intellectual Property Office of Singapore Examination Report; Application No. 2013027842; dated Feb. 27, 2015; pp. 1-12.

PCT International Search Report; International App. No. PCT/US2014/070650; dated Mar. 27, 2015; pp. 1-3.

PCT International Search Report; International App. No. PCT/US2014/070645; dated Mar. 16, 2015; pp. 1-3.

Abdalla et al.; "A Planar Electronically Steerable Patch Array Using Tunable PRI/NRI Phase Shifters"; IEEE Transactions on Microwave Theory and Techniques; Mar. 2009; p. 531-541; vol. 57, No. 3; IEEE.

Amineh et al.; "Three-Dimensional Near-Field Microwave Holography for Tissue Imaging"; International Journal of Biomedical Imaging; Bearing a date of Dec. 21, 2011; pp. 1-11; vol. 2012, Article ID 291494: Hindawi Publishing Corporation.

"Array Antenna with Controlled Radiation Pattern Envelope Manufacture Method"; ESA; Jan. 8, 2013; pp. 1-2; http://www.esa.int/Our_Activities/Technology/Array_antenna_with_controlled_radiation_pattern_envelope_manufacture_method.

Belloni, Fabio; "Channel Sounding"; S-72.4210 PG Course in Radio Communications; Bearing a date of Feb. 7, 2006; pp. 1-25.

Chen, Robert; Liquid Crystal Displays, Wiley, New Jersey 2011 (not provided).

Chin, J.Y. et al.; "An efficient broadband metamaterial wave retarder"; Optics Express; vol. 17, No. 9; p. 7640-7647; 2009.

Chu, R. S. et al.; "Analytical Model of a Multilayered Meaner-Line Polarizer Plate with Normal and Oblique Plane-Wave Incidence"; IEEE Trans. Ant. Prop.; vol. AP-35, No. 6; p. 652-661; Jun. 1987.

Colburn et al.; "Adaptive Artificial Impedance Surface Conformal Antennas"; in Proc. IEEE Antennas and Propagation Society Int. Symp.; 2009; p. 1-4.

Courreges et al.; "Electronically Tunable Ferroelectric Devices for Microwave Applications"; Microwave and Millimeter Wave Technologies from Photonic Bandgap Devices to Antenna and Applications; ISBN 978-953-7619-66-4; Mar. 2010; p. 185-204; InTech.

Cristaldi et al., Chapter 3 "Passive LCDs and Their Addressing Techniques" and Chapter 4 "Drivers for Passive-Matrix LCDs"; Liquid Crystal Display Drivers: Techniques and Circuits; ISBN 9048122546; Apr. 8, 2009; p. 75-143; Springer.

(56) References Cited

OTHER PUBLICATIONS

Den Boer, Wilem; Active Matrix Liquid Crystal Displays; Elsevier, Burlington, MA, 2009 (not provided).
Diaz, Rudy; "Fundamentals of EM Waves"; Bearing a date of Apr. 4, 2013; 6 total pages, located at: http://www.microwaves101.com/encyclopedia/absorbingradar1.cfm.
Elliott, R.S.; "An Improved Design Procedure for Small Arrays of Shunt Slots"; Antennas and Propagation, IEEE Transaction on; Jan. 1983; p. 297-300; vol. 31, Issue: 1; IEEE.
Elliott, Robert S. and Kurtz, L.A.; "The Design of Small Slot Arrays"; Antennas and Propagation, IEEE Transactions on; Mar. 1978; p. 214-219; vol. AP-26, Issue 2; IEEE.
European Patent Office, Supplementary European Search Report, pursuant to Rule 62 EPC; App. No. EP 11 83 2873; dated May 15, 2014; 7 pages.
Evlyukhin, Andrey B. and Bozhevolnyi, Sergey I.; "Holographic evanescent-wave focusing with nanoparticle arrays"; Optics Express; Oct. 27, 2008; p. 17 429-17 440; vol. 16, No. 22; OSA.
Fan, Yun-Hsing et al.; "Fast-response and scattering-free polymer network liquid crystals for infrared light modulators"; Applied Physics Letters; Feb. 23, 2004; p. 1233-1235; vol. 84, No. 8; American Institute of Physics.
Fong, Bryan H. et al.; "Scalar and Tensor Holographic Artificial Impedance Surfaces" IEEE Transactions on Antennas and Propagation; Oct. 2010; p. 3212-3221; vol. 58, No. 10; IEEE.
Frenzel, Lou; "What's the Difference Between EM Near Field and Far Field?"; Electronic Design; Bearing a date of Jun. 8, 2012; 7 total pages; located at: http://electronicdesign.com/energy/what-s-difference-between-em-field-and-far-field.
Grbic, Anthony; "Electrical Engineering and Computer Science"; University of Michigan; Create on Mar. 18, 2014, printed on Jan. 27, 2014; pp. 1-2; located at http://sitemaker.umich.edu/agrbic/projects.
Grbic et al.; "Metamaterial Surfaces for Near and Far-Field Applications"; 7m European Conference on Antennas and Propagation (EUCAP 2013); Bearing a date of 2013, Created on Mar. 18, 2014; pp. 1-5.
Hand, Thomas H. et al.; "Characterization of complementary electric field coupled resonant surfaces"; Applied Physics Letters; published on Nov. 26, 2008; pp. 212504-1-212504-3; vol. 93; Issue 21; American Institute of Physics.
Imani et al.; "A Concentrically Corrugated Near-Field Plate"; Bearing a date of 2010; Created on Mar. 18, 2014; pp. 1-4; IEEE.
Imani et al.; "Design of a Planar Near-Field Plate"; Bearing at date of 2012, Created on Mar. 18, 2014; pp. 102, IEEE.
Imani et al.; "Planar Near-Field Plates"; Bearing a date of 2013, Create on Mar. 18, 2014; pp. 1-10; IEEE.
Islam et al.; "A Wireless Channel Sounding System for Rapid Propagation Measurements"; Bearing a date of Nov. 21, 2012, 7 total pages.
Kaufman, D.Y. et al.; "High-Dielectric-Constant Ferroelectric Thin Film and Bulk Ceramic Capacitors for Power Electronics"; Proceedings of the Power Systems World/Power Conversion and Intelligent Motion '99 Conference; Nov. 6-12, 1999; p. 1-9; PSW/PCIM; Chicago, IL.
Kim, David Y.; "A Design Procedure for Slot Arrays Fed by Single-Ridge Waveguide"; IEEE Transactions on Antennas and Propagation; Nov. 1988; p. 1531-1536; vol. 36, No. 11; IEEE.
Kirschbaum, H.S. et al.; "A Method of Producing Broad-Band Circular Polarization Employing an Anisotropic Dielectric"; IRE Trans. Micro. Theory. Tech.; vol. 5, No. 3; p. 199-203; 1957.
Kokkinos, Titos et al.; "Periodic FDTD Analysis of Leaky-Wave Structures and Applications to the Analysis of Negative-Refractive-Index Leaky-Wave Antennas"; IEEE Transactions on Microwave Theory and Techniques; 2006; p. 1-12; IEEE.
Konishi, Yohei; "Channel Sounding Technique Using MIMO Software Radio Architecture"; 1th MCRG Joint Seminar: Bearing a date of Nov. 18, 2010; 28 total pages.
Kuki, Takao et al., "Microwave Variable Delay Line using a Membrane Impregnated with Liquid Crystal"; Microwave Symposium Digest; ISBN 0-7803-7239-5; Jun. 2-7, 2002; p. 363-366; IEEE MTT-S International.
Leveau et al.; "Anti-Jam Protection by Antenna"; GPS World; Feb. 1, 2013; pp. 1-11; North Coast Media LLC; http://gpsworld.com/anti-jam-protection-by-antenna/.
Lipworth et al.; "Magnetic Metamaterial Superlens for Increase Range Wireless Power Transfer"; Scientific Reports; Bearing a date of Jan. 101, 2014; pp. 1-6; vol. 4, No. 3642.
Luo et al.; "Rig-directivity antenna with small antenna aperture"; Applied Physics Letters; 2009; pp. 193506-1-193506-3; vol. 95; American Institute of Physics.
Manasson et al.; "Electronically Reconfigurable Aperture (ERA): A New Approach for Beam-Steering Technology"; Bearing dates of Oct. 12-15, 2010; pp. 673-679; IEEE.
McLean et al.; "Interpreting Antenna Performance Parameters for EMC Applications: Part 2: Radiation Patter, Gain, and Directivity"; Created on Apr. 1, 2014; pp. 7-17; TDK RF Solutions Inc.
Mitri, F.G.; "Quasi-Gaussian Electromagnetic Beams"; Physical Review A.; Bearing a date of Mar. 11, 2013; p. I; vol. 87, No. 035804; (Abstract Only).
Ovi et al.; "Symmetrical Slot Loading in Elliptical Microstrip Patch antennas Partially Filled with Mue Negative Metamaterials"; PIERS Proceedings, Moscow, Russia; Aug. 19-23, 2012; nn. 542-545.
PCT International Search Report; International App. No. PCT/US2014/0I 7454; dated Aug. 28, 2014; pp. 1-4.
PCT International Search Report; International App. No. PCT/US201 I/001755; dated Mar. 22, 2012; pp. 1-5.
Poplavlo, Yuriy et al.; "Tunable Dielectric Microwave Devices with Electromechanical Control"; Passive Microwave Components and Antennas; ISBN 978-953-307-083-4; Apr. 2010; p. 367-382; InTech.
Rengarajan, Sembiam R. et al.; "Design, Analysis, and Development of a Large Ka-Band Slot Array for Digital Beam-Forming Application"; IEEE Transactions on Antennas and Propagation; Oct. 2009; p. 3103-3109; vol. 57, No. 10; IEEE.
Sakakibara, Kunio; "High-Gain Millimeter-Wave Planar Array Antennas with Traveling-Wave Excitation"; Radar Technology; Bearing a date of Dec. 2009; pp. 319-340.
Sandell et al.; "Joint Data Detection and Channel Sounding for TDD Systems with Antenna Selection"; Bearing a date of 2011, Created on Mar. 18, 2014; pp. 1-5; IEEE.
"Satellite Navigation"; Crosslink; The Aerospace Corporation magazine of advances in aerospace technology; Summer 2002; vol. 3, No. 2; pp. 1-56; The Aerospace Corporation.
Sato, Kazuo et al.; "Electronically Scanned Left-Handed Leaky Wave Antenna for Millimeter-Wave Automotive Applications"; Antenna Technology Small Antennas and Novel Metamaterials; 2006; p. 420-423; IEEE.
Siciliano et al.; "25. Multisensor Data Fusion"; Springer Handbook of Robotics; Bearing a date of 2008, Created on Mar. 18, 2014; 27 total pages; Springer.
Sievenpiper, Dan et al.; "Holographic Artificial Impedance Surfaces for Conformal Antennas"; Antennas and Propagation Society International Symposium; 2005; p. 256-259; vol. IB; IEEE, Washington D.C.
Sievenpiper, Daniel F. et al.; "Two-Dimensional Beam Steering Using an Electrically Tunable Impedance Surface"; IEEE Transactions on Antennas and Propagation; Oct. 2003; p. 2713-2722; vol. 51, No. 10; IEEE.
Smith, David R.; "Recent Progress in Metamaterial and Transformation Optical Design"; NAVAIR Nano/Meta Workshop; Feb. 2-3, 2011; pp. 1-32.
Soper, Taylor; "This startup figured out how to charge devices wirelessly through walls from 40 feet away"; GeekWire; bearing a date of Apr. 22, 2014 and printed on Apr. 24, 2014; pp. 1-12; located at http://www.geekwire.com/2014/ossia-wireless-charging/#disqus_thread.
"Spectrum Analyzer"; Printed on Aug. 12, 2013; pp. 1-2; http://www.gpssource.com/faqs/15; GPS Source.
Sun et al.; "Maximum Signal-to-Noise Ratio GPS Anti-Jam Receiver with Subspace Tracking"; ICASSP; 2005; pp. IV-1085-IV-1088; IEEE.

(56) References Cited

OTHER PUBLICATIONS

Thoma et al.; "MIMO Vector Channel Sounder Measurement for Smart Antenna System Evaluation"; Created on Mar. 18, 2014; pp. 1-12.
Umenei, A.E.; "Understanding Low Frequency Non-Radiative Power Transfer"; Bearing a date of Jun. 2011; 7 total pages; Fulton Innovation LLC.
Utsumi, Yozo et al.; "Increasing the Speed of Microstrip-Line-Type Polymer-Dispersed Liquid-Crystal Loaded Variable Phase Shifter"; IEEE Transactions on Microwave Theory and Techniques; Nov. 2005, p. 3345-3353; vol. 53, No. 11; IEEE.
Wallace, John; "Flat 'Metasurface' Becomes Aberration-Free Lens"; Beaming a date of Aug. 28, 2012; 4 total pages; located at: http://www.laserfocusworld.com/articles/2012/08/flat-metasurface-becomes-aberration-free-lens.html.
"Wavenumber"; Microwave Encyclopedia; bearing a date of Jan. 12, 2008; pp. 1-2; P-N Designs, Inc.
Weil, Carsten et al.; "Tunable Inverted-Microstrip Phase Shifter Device Using Nematic Liquid Crystals"; IEEE MTT-S Digest; 2002; p. 367-370; IEEE.
Yan, Dunbao et al.; "A Novel Polarization Convert Surface Based on Artificial Magnetic Conductor"; Asia-Pacific Microwave Conference Proceedings, 2005.
Yee, Hung Y.; "Impedance of a Narrow Longitudinal Shunt Slot in a Slotted Waveguide Array"; IEEE Transactions on Antennas and Propagation; Jul. 1974; p. 589-592; IEEE.
Yoon et al.; "Realizing Effcient Wireless Power Transfer in the Near-Field Region Using Electrically small Antennas"; Wireless Power Transfer; Principles and Engineering Explorations: Bearing a date of Jan. 25, 2012; pp. 151-172.
Young et al.; "Meander-Line Polarizer"; IEEE Trans. Ant. Prop.; p. 376-378; May 1973.
Zhong, S.S. et al.; "Compact ridge waveguide slot antenna array fed by convex waveguide divider"; Electronics Letters; Oct. 13, 2005; p. 1-2; vol. 41, No. 21; IEEE.

* cited by examiner

SURFACE SCATTERING ANTENNAS WITH LUMPED ELEMENTS

CROSS-REFERENCE TO RELATED APPLICATIONS

U.S. Patent Application No. 61/455,171, entitled SURFACE SCATTERING ANTENNAS, naming NATHAN KUNDTZ ET AL. as inventors, filed Oct. 15, 2010, is related to the present application.

U.S. patent application Ser. No. 13/317,338, entitled SURFACE SCATTERING ANTENNAS, naming ADAM BILY, ANNA K. BOARDMAN, RUSSELL J. HANNIGAN, JOHN HUNT, NATHAN KUNDTZ, DAVID R. NASH, RYAN ALLAN STEVENSON, AND PHILIP A. SULLIVAN as inventors, filed Oct. 14, 2011, is related to the present application.

U.S. patent application Ser. No. 13/838,934, entitled SURFACE SCATTERING ANTENNA IMPROVEMENTS, naming ADAM BILY, JEFF DALLAS, RUSSELL J. HANNIGAN, NATHAN KUNDTZ, DAVID R. NASH, AND RYAN ALLAN STEVEN as inventors, filed Mar. 15, 2013, is related to the present application.

The present application claims benefit of priority of U.S. Provisional Patent Application No. 61/988,023, entitled SURFACE SCATTERING ANTENNAS WITH LUMPED ELEMENTS, naming PAI-YEN CHEN, TOM DRISCOLL, SIAMAK EBADI, JOHN DESMOND HUNT, NATHAN INGLE LANDY, MELROY MACHADO, MILTON PERQUE, DAVID R. SMITH, AND YAROSLAV A. URZHUMOV as inventors, filed May 2, 2014, which was filed within the twelve months preceding the filing date of the present application.

All subject matter of the above applications is incorporated herein by reference to the extent such subject matter is not inconsistent herewith.

DETAILED DESCRIPTION

Figure 1:
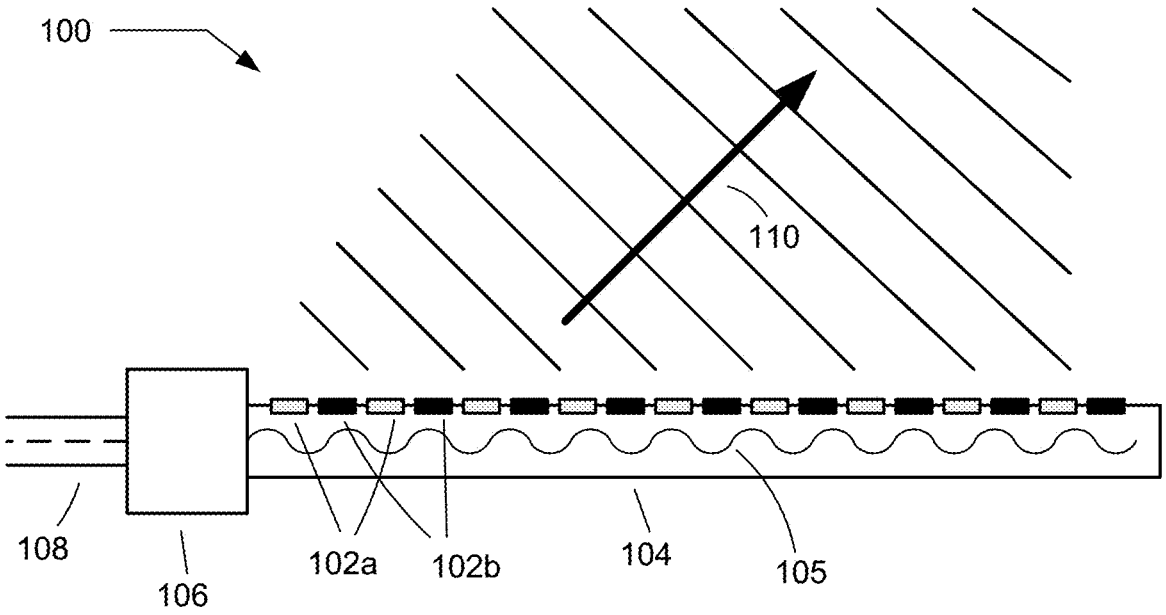
FIG. 1 is a schematic depiction of a surface scattering antenna.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. A schematic illustration of a surface scattering antenna is depicted in FIG. 1.

The surface scattering antenna 100 includes a plurality of scattering elements 102*a*, 102*b* that are distributed along a wave-propagating structure 104. The wave propagating structure 104 may be a microstrip, a stripline, a coplanar waveguide, a parallel plate waveguide, a dielectric rod or slab, a closed or tubular waveguide, a substrate-integrated waveguide, or any other structure capable of supporting the propagation of a guided wave or surface wave 105 along or within the structure. The wavy line 105 is a symbolic depiction of the guided wave or surface wave, and this symbolic depiction is not intended to indicate an actual wavelength or amplitude of the guided wave or surface wave; moreover, while the wavy line 105 is depicted as within the wave-propagating structure 104 (e.g. as for a guided wave in a metallic waveguide), for a surface wave the wave may be substantially localized outside the wave-propagating structure (e.g. as for a TM mode on a single wire transmission line or a "spoof plasmon" on an artificial impedance surface). It is also to be noted that while the disclosure herein generally refers to the guided wave or surface wave 105 as a propagating wave, other embodiments are contemplated that make use of a standing wave that is a superposition of an input wave and reflection(s)s thereof. The scattering elements 102*a*, 102*b* may include scattering elements that are embedded within, positioned on a surface of, or positioned within an evanescent proximity of, the wave-propagation structure 104. For example, the scattering elements can include complementary metamaterial elements such as those presented in D. R. Smith et al, "Metamaterials for surfaces and waveguides," U.S. Patent Application Publication No. 2010/0156573, and A. Bily et al, "Surface scattering antennas," U.S. Patent Application Publication No. 2012/0194399, each of which is herein incorporated by reference. As another example, the scattering elements can include patch elements such as those presented in A. Bily et al, "Surface scattering antenna improvements," U.S. U.S. patent application Ser. No. 13/838,934, which is herein incorporated by reference.

The surface scattering antenna also includes at least one feed connector 106 that is configured to couple the wave-propagation structure 104 to a feed structure 108. The feed structure 108 (schematically depicted as a coaxial cable) may be a transmission line, a waveguide, or any other structure capable of providing an electromagnetic signal that may be launched, via the feed connector 106, into a guided wave or surface wave 105 of the wave-propagating structure 104. The feed connector 106 may be, for example, a coaxial-to-microstrip connector (e.g. an SMA-to-PCB adapter), a coaxial-to-waveguide connector, a coaxial-to-SIW (substrated-integrated waveguide) connector, a mode-matched transition section, etc. While FIG. 1 depicts the feed connector in an "end-launch" configuration, whereby the guided wave or surface wave 105 may be launched from a peripheral region of the wave-propagating structure (e.g. from an end of a microstrip or from an edge of a parallel plate waveguide), in other embodiments the feed structure may be attached to a non-peripheral portion of the wave-propagating structure, whereby the guided wave or surface wave 105 may be launched from that non-peripheral portion of the wave-propagating structure (e.g. from a midpoint of a microstrip or through a hole drilled in a top or bottom plate of a parallel plate waveguide); and yet other embodiments may provide a plurality of feed connectors attached to the wave-propagating structure at a plurality of locations (peripheral and/or non-peripheral).

The scattering elements 102*a*, 102*b* are adjustable scattering elements having electromagnetic properties that are adjustable in response to one or more external inputs. Various embodiments of adjustable scattering elements are described, for example, in D. R. Smith et al, previously cited, and further in this disclosure. Adjustable scattering elements can include elements that are adjustable in response to voltage inputs (e.g. bias voltages for active elements (such as varactors, transistors, diodes) or for elements that incorporate tunable dielectric materials (such as ferroelectrics or liquid crystals)), current inputs (e.g. direct injection of charge carriers into active elements), optical inputs (e.g. illumination of a photoactive material), field inputs (e.g. magnetic fields for elements that include non-linear magnetic materials), mechanical inputs (e.g. MEMS, actuators, hydraulics), etc. In the schematic example of FIG. 1, scattering elements that have been adjusted to a first state having first electromagnetic properties are depicted as the first elements 102*a*, while scattering elements that have been adjusted to a second state having second electromagnetic properties are depicted as the second elements 102*b*. The depiction of scattering elements having first and second states corresponding to first and second electromagnetic properties is not intended to be limiting: embodiments may provide scattering elements that are discretely adjustable to select from a discrete plurality of states corresponding to a discrete plurality of different electromagnetic properties, or continuously adjustable to select from a continuum of states corresponding to a continuum of different electromagnetic properties. Moreover, the particular pattern of adjustment that is depicted in FIG. 1 (i.e. the alternating arrangement of elements 102*a* and 102*b*) is only an exemplary configuration and is not intended to be limiting.

In the example of FIG. 1, the scattering elements 102*a*, 102*b* have first and second couplings to the guided wave or surface wave 105 that are functions of the first and second electromagnetic properties, respectively. For example, the first and second couplings may be first and second polarizabilities of the scattering elements at the frequency or frequency band of the guided wave or surface wave. In one approach the first coupling is a substantially nonzero coupling whereas the second coupling is a substantially zero coupling. In another approach both couplings are substantially nonzero but the first coupling is substantially greater than (or less than) than the second coupling. On account of the first and second couplings, the first and second scattering elements 102*a*, 102*b* are responsive to the guided wave or surface wave 105 to produce a plurality of scattered electromagnetic waves having amplitudes that are functions of (e.g. are proportional to) the respective first and second couplings. A superposition of the scattered electromagnetic waves comprises an electromagnetic wave that is depicted, in this example, as a plane wave 110 that radiates from the surface scattering antenna 100.

The emergence of the plane wave may be understood by regarding the particular pattern of adjustment of the scattering elements (e.g. an alternating arrangement of the first and second scattering elements in FIG. 1) as a pattern that defines a grating that scatters the guided wave or surface wave 105 to produce the plane wave 110. Because this pattern is adjustable, some embodiments of the surface scattering antenna may provide adjustable gratings or, more generally, holograms, where the pattern of adjustment of the scattering elements may be selected according to principles of holography. Suppose, for example, that the guided wave or surface wave may be represented by a complex scalar input wave $\Psi_{in}$ that is a function of position along the wave-propagating structure 104, and it is desired that the surface scattering antenna produce an output wave that may be represented by another complex scalar wave $\Psi_{out}$. Then a pattern of adjustment of the scattering elements may be selected that corresponds to an interference pattern of the input and output waves along the wave-propagating structure. For example, the scattering elements may be adjusted to provide couplings to the guided wave or surface wave that are functions of (e.g. are proportional to, or step-functions of) an interference term given by $\mathrm{Re}[\Psi_{out}\Psi_{in}^*]$. In this way, embodiments of the surface scattering antenna may be adjusted to provide arbitrary antenna radiation patterns by identifying an output wave $\Psi_{out}$ corresponding to a selected beam pattern, and then adjusting the scattering elements accordingly as above. Embodiments of the surface scattering antenna may therefore be adjusted to provide, for example, a selected beam direction (e.g. beam steering), a selected beam width or shape (e.g. a fan or pencil beam having a broad or narrow beamwidth), a selected arrangement of nulls (e.g. null steering), a selected arrangement of multiple beams, a selected polarization state (e.g. linear, circular, or elliptical polarization), a selected overall phase, or any combination thereof. Alternatively or additionally, embodiments of the surface scattering antenna may be adjusted to provide a selected near field radiation profile, e.g. to provide near-field focusing and/or near-field nulls.

Because the spatial resolution of the interference pattern is limited by the spatial resolution of the scattering elements, the scattering elements may be arranged along the wave-propagating structure with inter-element spacings that are much less than a free-space wavelength corresponding to an operating frequency of the device (for example, less than one-third, one-fourth, or one-fifth of this free-space wavelength). In some approaches, the operating frequency is a microwave frequency, selected from frequency bands such as L, S, C, X, Ku, K, Ka, Q, U, V, E, W, F, and D, corresponding to frequencies ranging from about 1 GHz to 170 GHz and free-space wavelengths ranging from millimeters to tens of centimeters. In other approaches, the operating frequency is an RF frequency, for example in the range of about 100 MHz to 1 GHz. In yet other approaches, the operating frequency is a millimeter-wave frequency, for example in the range of about 170 GHz to 300 GHz. These ranges of length scales admit the fabrication of scattering elements using conventional printed circuit board or lithographic technologies.

Figure 2A:
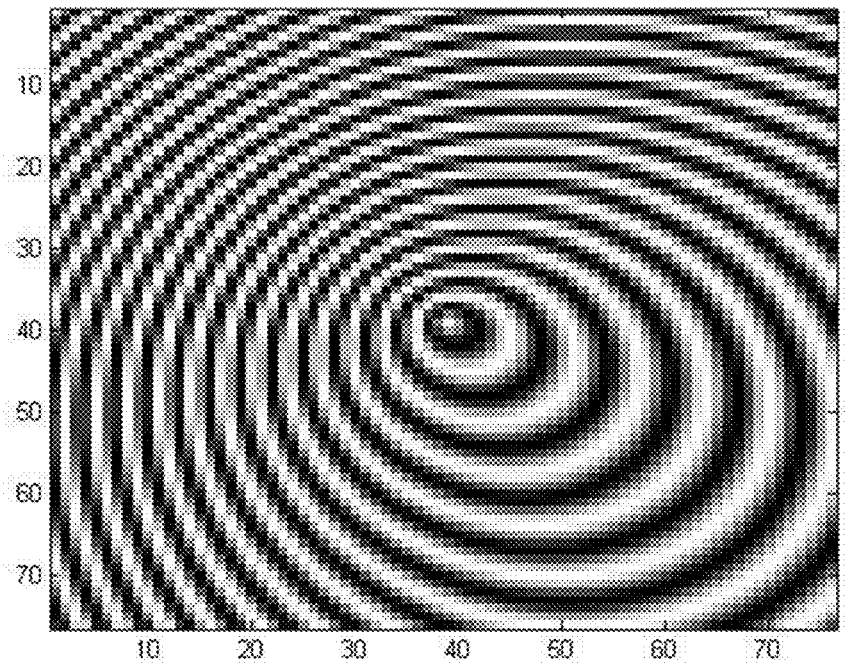
FIGS. 2A and 2B respectively depict an exemplary adjustment pattern and corresponding beam pattern for a surface scattering antenna.
Figure 2B:
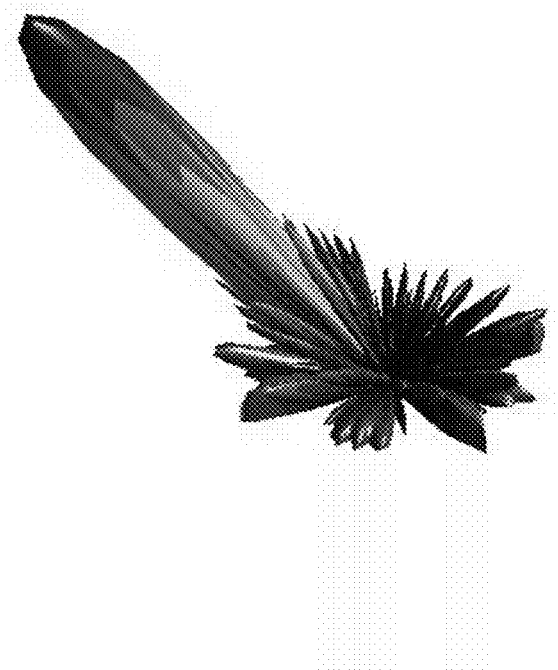
Figure 3A:
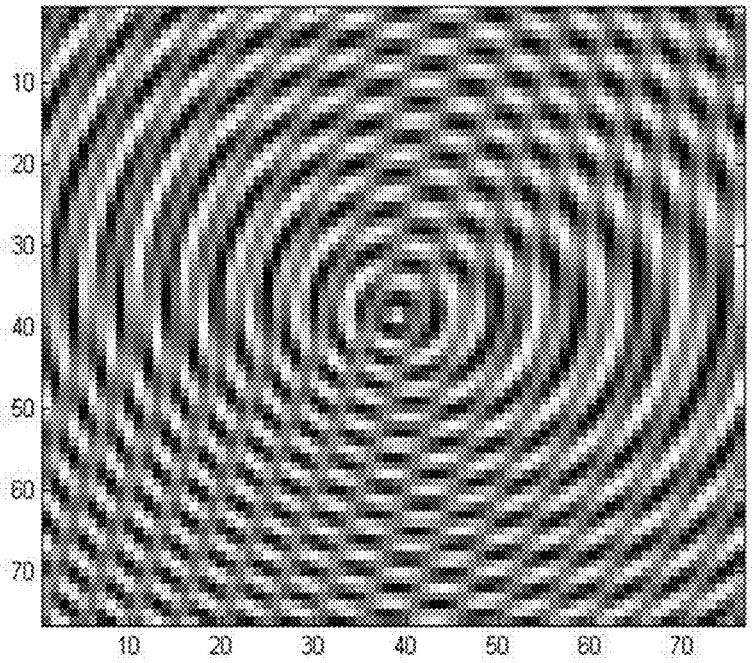
FIGS. 3A and 3B respectively depict another exemplary adjustment pattern and corresponding beam pattern for a surface scattering antenna.
Figure 3B:
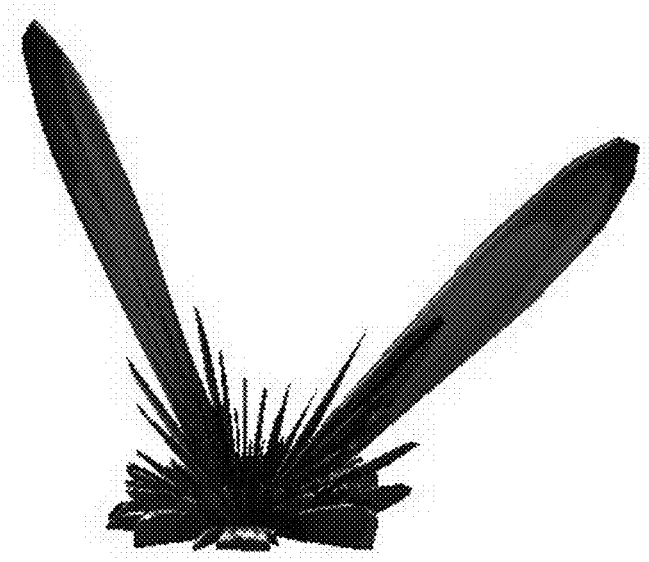
Figure 4A:
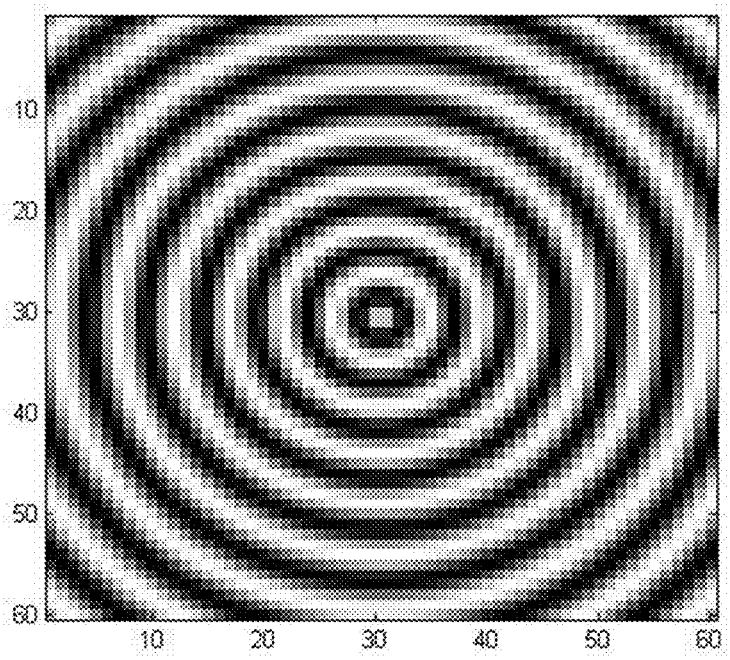
FIGS. 4A and 4B respectively depict another exemplary adjustment pattern and corresponding field pattern for a surface scattering antenna.
Figure 4B:
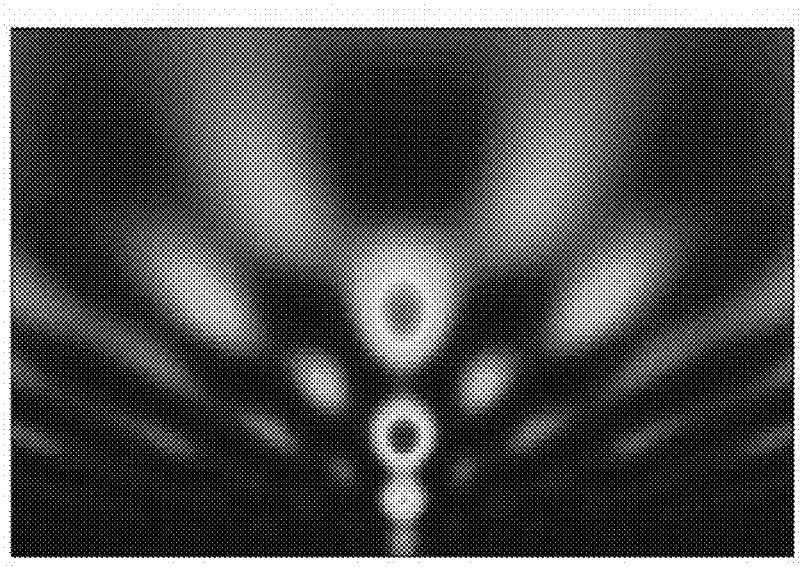

In some approaches, the surface scattering antenna includes a substantially one-dimensional wave-propagating structure 104 having a substantially one-dimensional arrangement of scattering elements, and the pattern of adjustment of this one-dimensional arrangement may provide, for example, a selected antenna radiation profile as a function of zenith angle (i.e. relative to a zenith direction that is parallel to the one-dimensional wave-propagating structure). In other approaches, the surface scattering antenna includes a substantially two-dimensional wave-propagating structure 104 having a substantially two-dimensional arrangement of scattering elements, and the pattern of adjustment of this two-dimensional arrangement may provide, for example, a selected antenna radiation profile as a function of both zenith and azimuth angles (i.e. relative to a zenith direction that is perpendicular to the two-dimensional wave-propagating structure). Exemplary adjustment patterns and beam patterns for a surface scattering antenna that includes a two-dimensional array of scattering elements distributed on a planar rectangular wave-propagating structure are depicted in FIGS. 2A-4B. In these exemplary embodiments, the planar rectangular wave-propagating structure includes a monopole antenna feed that is positioned at the geometric center of the structure. FIG. 2A presents an adjustment pattern that corresponds to a narrow beam having a selected zenith and azimuth as depicted by the beam pattern diagram of FIG. 2B. FIG. 3A presents an adjustment pattern that corresponds to a dual-beam far field pattern as depicted by the beam pattern diagram of FIG. 3B. FIG. 4A presents an adjustment pattern that provides near-field focusing as depicted by the field intensity map of FIG. 4B (which depicts the field intensity along a plane perpendicular to and bisecting the long dimension of the rectangular wave-propagating structure).

In some approaches, the wave-propagating structure is a modular wave-propagating structure and a plurality of modular wave-propagating structures may be assembled to compose a modular surface scattering antenna. For example, a plurality of substantially one-dimensional wave-propagating structures may be arranged, for example, in an interdigital fashion to produce an effective two-dimensional arrangement of scattering elements. The interdigital arrangement may comprise, for example, a series of adjacent linear structures (i.e. a set of parallel straight lines) or a series of adjacent curved structures (i.e. a set of successively offset curves such as sinusoids) that substantially fills a two-dimensional surface area. These interdigital arrangements may include a feed connector having a tree structure, e.g. a binary tree providing repeated forks that distribute energy from the feed structure 108 to the plurality of linear structures (or the reverse thereof). As another example, a plurality of substantially two-dimensional wave-propagating structures (each of which may itself comprise a series of one-dimensional structures, as above) may be assembled to produce a larger aperture having a larger number of scattering elements; and/or the plurality of substantially two-dimensional wave-propagating structures may be assembled as a three-dimensional structure (e.g. forming an A-frame structure, a pyramidal structure, or other multi-faceted structure). In these modular assemblies, each of the plurality of modular wave-propagating structures may have its own feed connector(s) 106, and/or the modular wave-propagating structures may be configured to couple a guided wave or surface wave of a first modular wave-propagating structure into a guided wave or surface wave of a second modular wave-propagating structure by virtue of a connection between the two structures.

In some applications of the modular approach, the number of modules to be assembled may be selected to achieve an aperture size providing a desired telecommunications data capacity and/or quality of service, and/or a three-dimensional arrangement of the modules may be selected to reduce potential scan loss. Thus, for example, the modular assembly could comprise several modules mounted at various locations/orientations flush to the surface of a vehicle such as an aircraft, spacecraft, watercraft, ground vehicle, etc. (the modules need not be contiguous). In these and other approaches, the wave-propagating structure may have a substantially non-linear or substantially non-planar shape whereby to conform to a particular geometry, therefore providing a conformal surface scattering antenna (conforming, for example, to the curved surface of a vehicle).

More generally, a surface scattering antenna is a reconfigurable antenna that may be reconfigured by selecting a pattern of adjustment of the scattering elements so that a corresponding scattering of the guided wave or surface wave produces a desired output wave. Suppose, for example, that the surface scattering antenna includes a plurality of scattering elements distributed at positions $\{r_j\}$ along a wave-propagating structure 104 as in FIG. 1 (or along multiple wave-propagating structures, for a modular embodiment) and having a respective plurality of adjustable couplings $\{\alpha_j\}$ to the guided wave or surface wave 105. The guided wave or surface wave 105, as it propagates along or within the (one or more) wave-propagating structure(s), presents a wave amplitude $A_j$ and phase $\Phi_j$ to the jth scattering element; subsequently, an output wave is generated as a superposition of waves scattered from the plurality of scattering elements:

$$E(\theta, \phi) = \sum_j R_j(\theta, \phi)\alpha_j A_j e^{i\varphi_j} e^{i(k(\theta,\phi)\cdot r_j)}, \tag{1}$$

where $E(\theta,\phi)$ represents the electric field component of the output wave on a far-field radiation sphere, $R_j(\theta,\phi)$ represents a (normalized) electric field pattern for the scattered wave that is generated by the jth scattering element in response to an excitation caused by the coupling $\alpha_j$, and $k(\theta,\phi)$ represents a wave vector of magnitude $\omega/c$ that is perpendicular to the radiation sphere at $(\theta,\phi)$. Thus, embodiments of the surface scattering antenna may provide a reconfigurable antenna that is adjustable to produce a desired output wave $E(\theta,\phi)$ by adjusting the plurality of couplings $\{\alpha_j\}$ in accordance with equation (1).

The wave amplitude $A_j$ and phase $\varphi_j$ of the guided wave or surface wave are functions of the propagation characteristics of the wave-propagating structure 104. Thus, for example, the amplitude $A_j$ may decay exponentially with distance along the wave-propagating structure, $A_j \sim A_0 \exp(-\kappa x_j)$, and the phase $\varphi_j$ may advance linearly with distance along the wave-propagating structure, $\varphi_j \sim \varphi_0 + \beta x_j$, where $\kappa$ is a decay constant for the wave-propagating structure, $\beta$ is a propagation constant (wavenumber) for the wave-propagating structure, and $x_j$ is a distance of the jth scattering element along the wave-propagating structure. These propagation characteristics may include, for example, an effective refractive index and/or an effective wave impedance, and these effective electromagnetic properties may be at least partially determined by the arrangement and adjustment of the scattering elements along the wave-propagating structure. In other words, the wave-propagating structure, in combination with the adjustable scattering elements, may provide an adjustable effective medium for propagation of the guided wave or surface wave, e.g. as described in D. R. Smith et al, previously cited. Therefore, although the wave amplitude $A_j$ and phase $\varphi_j$ of the guided wave or surface wave may depend upon the adjustable scattering element couplings $\{\alpha_j\}$ (i.e. $A_i = A_i(\{\alpha_j\})$, $\varphi_j = \varphi_i(\{\alpha_j\})$), in some embodiments these dependencies may be substantially predicted according to an effective medium description of the wave-propagating structure.

In some approaches, the reconfigurable antenna is adjustable to provide a desired polarization state of the output wave $E(\theta,\phi)$. Suppose, for example, that first and second subsets $LP^{(1)}$ and $LP^{(2)}$ of the scattering elements provide (normalized) electric field patterns $R^{(1)}(\theta,\phi)$ and $R^{(2)}(\theta,\phi)$, respectively, that are substantially linearly polarized and substantially orthogonal (for example, the first and second subjects may be scattering elements that are perpendicularly oriented on a surface of the wave-propagating structure 104). Then the antenna output wave $E(\theta,\phi)$ may be expressed as a sum of two linearly polarized components:

$$E(\theta,\phi) = E^{(1)}(\theta,\phi) + E^{(2)}(\theta,\phi) = \Lambda^{(1)}R^{(1)}(\theta,\phi) + \Lambda^{(2)}R^{(2)}(\theta,\phi), \quad (2)$$

where $$\Lambda^{(1,2)}(\theta,\phi) = \sum_{j\in LP^{(1,2)}} \alpha_j A_j e^{i\varphi_j} e^{i(k(\theta,\phi)\cdot r_j)} \quad (3)$$

are the complex amplitudes of the two linearly polarized components. Accordingly, the polarization of the output wave $E(\theta,\phi)$ may be controlled by adjusting the plurality of couplings $\{\alpha_j\}$ in accordance with equations (2)-(3), e.g. to provide an output wave with any desired polarization (e.g. linear, circular, or elliptical).

Alternatively or additionally, for embodiments in which the wave-propagating structure has a plurality of feeds (e.g. one feed for each "finger" of an interdigital arrangement of one-dimensional wave-propagating structures, as discussed above), a desired output wave $E(\theta,\phi)$ may be controlled by adjusting gains of individual amplifiers for the plurality of feeds. Adjusting a gain for a particular feed line would correspond to multiplying the $A_j$'s by a gain factor G for those elements j that are fed by the particular feed line. Especially, for approaches in which a first wave-propagating structure having a first feed (or a first set of such structures/feeds) is coupled to elements that are selected from $LP^{(1)}$ and a second wave-propagating structure having a second feed (or a second set of such structures/feeds) is coupled to elements that are selected from $LP^{(2)}$, depolarization loss (e.g., as a beam is scanned off-broadside) may be compensated by adjusting the relative gain(s) between the first feed(s) and the second feed(s).

Figure 5:
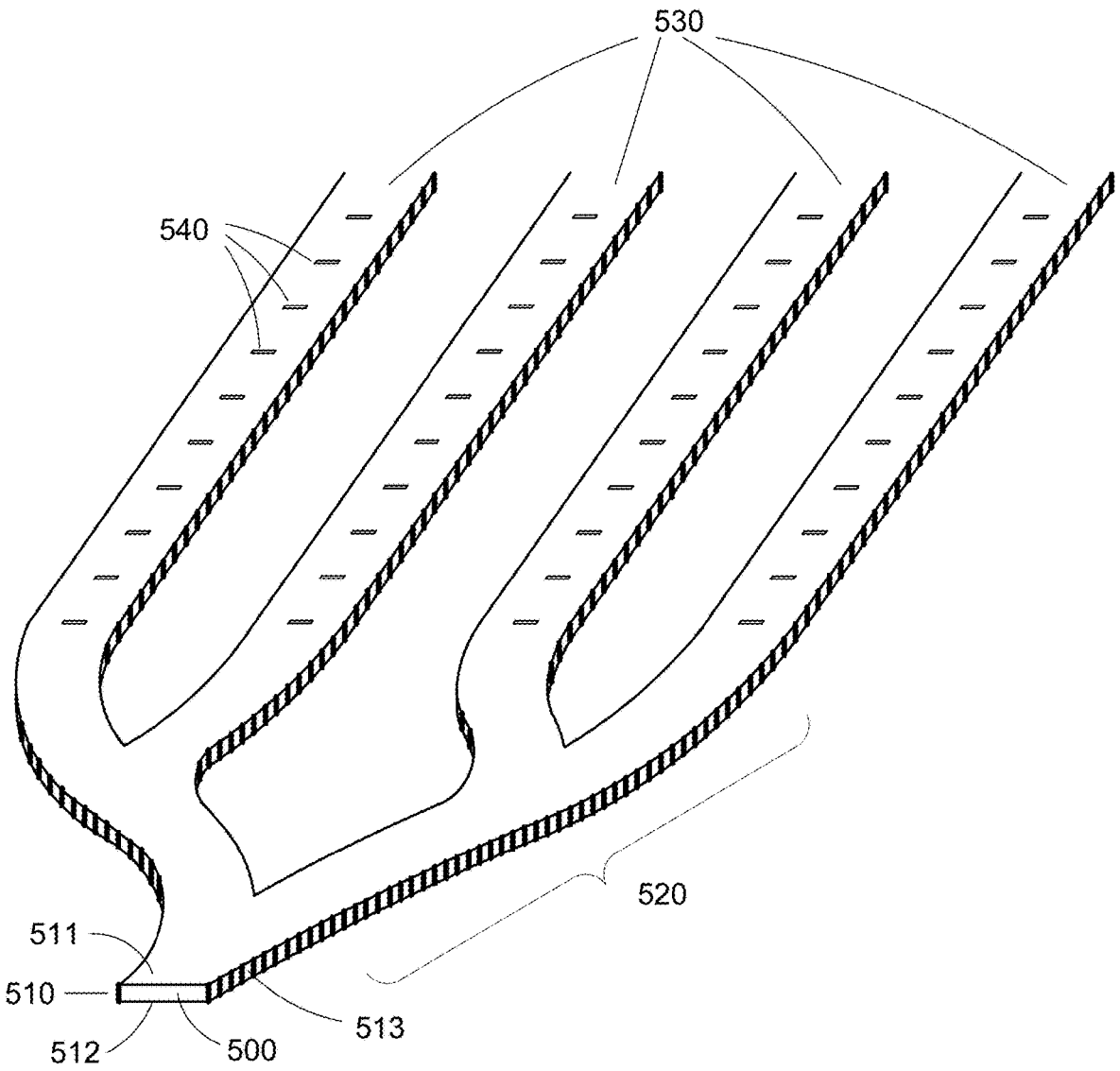
FIG. 5 depicts an exemplary substrate-integrated waveguide.

As mentioned previously in the context of FIG. 1, in some approaches the surface scattering antenna 100 includes a wave-propagating structure 104 that may be implemented as a closed waveguide (or a plurality of closed waveguides). FIG. 5 depicts an exemplary closed waveguide implemented as a substrate-integrated waveguide. A substrate-integrated waveguide typically includes a dielectric substrate 510 defining an interior of the waveguide, a first conducting surface 511 above the substrate defining a "ceiling" of the waveguide, a second conducting surface 512 defining a "floor" of the waveguide, and one or more colonnades of vias 513 between the first conducting surface and the second conducting surface defining the walls of the waveguide. Substrate-integrated waveguides are amenable to fabrication by standard printed-circuit board (PCB) processes. For example, a substrate-integrated waveguide may be implemented using an epoxy laminate material (such as FR-4) or a hydrocarbon/ceramic laminate (such as Rogers 4000 series) with copper cladding on the upper and lower surfaces of the laminate. A multi-layer PCB process may then be employed to situate the scattering elements above the substrate-integrated waveguide, and/or to place control circuitry below the substrate-integrated waveguide, as further discussed below. Substrate-integrated waveguides are also amenable to fabrication by very-large scale integration (VLSI) processes. For example, for a VLSI process providing multiple metal and dielectric layers, the substrate-integrated waveguide can be implemented with a lower metal layer as the floor of the waveguide, one or more dielectric layers as the interior of the waveguide, and a higher metal layer as the ceiling of the waveguide, with a series of masks defining the footprint of the waveguide and the arrangement of inter-layer vias for the waveguide walls.

In the example of FIG. 5, the substrate-integrated waveguide includes a plurality of parallel one-dimensional waveguides 530. To distribute a guided wave to this plurality of waveguide "fingers," the substrate-integrate waveguide includes a power divider section 520 that distributes energy delivered at the input port 500 to the plurality of fingers 530. As shown in this example, the power divider 520 may be implemented as a tree-like structure, e.g. a binary tree. Each of the parallel one-dimensional waveguides 530 supports a set of scattering elements arranged along the length of the waveguide, so that the entire set of scattering elements can fill a two-dimensional antenna aperture, as discussed previously. The scattering elements may be coupled to the guided wave that propagates within the substrate-integrated waveguide by an arrangement of apertures or irises 540 on the upper conducting surface of the waveguides. These irises 540 are depicted as rectangular slots in FIG. 5, but this is not intended to be limiting, and other iris geometrics may include squares, circles, ellipses, crosses, etc. Some approaches may use multiple sub-irises per unit cell, e.g. a set of parallel thin slits aligned perpendicular to the length of the waveguide. It is to be appreciated that while various embodiments described below use a substrate-integrated waveguide or stripline waveguide to distribute a guided wave, any other waveguide may be substituted; for example, the top board(s) of the multi-layer PCB assemblies described below may provide the upper surface of a rectangular waveguide rather than being assembled (as below) with lower board(s) providing a substrate-integrated waveguide or stripline.

While FIG. 5 depicts a power divider 520 and plurality of one-dimensional waveguides 530 that are both implemented as substrate-integrated waveguides, similar arrangements are contemplated using other types of waveguide structures. For example, the power divider and the plurality of one-dimensional waveguides can be implemented using microstrip structures, stripline structures, coplanar waveguide structures, etc.

Turning now to a consideration of the scattering elements that are coupled to the waveguide, FIGS. 6A-6F depict schematic configurations of scattering elements that are adjustable using lumped elements. Throughout this disclosure, the term "lumped element" shall be generally understood to include bare die, flip-chip, discrete, or packaged electronic components. These can include two-terminal lumped elements such as packaged resistors, capacitors, inductors, diodes, etc.; three-terminal lumped elements such as transistors and three-port tunable capacitors; and lumped elements with more than three terminals, such as op-amps. Lumped elements shall also be understood to include packaged integrated circuits, e.g. a tank (LC) circuit integrated in a single package, or a diode or transistor with an integrated RF choke.

Figure 6A:
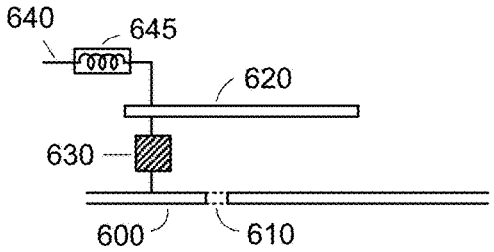
FIGS. 6A-6F depict schematic configurations of scattering elements that are adjustable using lumped elements.

In the configuration of FIG. 6A, the scattering element is depicted as a conductor 620 positioned above an aperture 610 in a ground body 600. For example, the scattering element may be a patch antenna element, in which case the conductor 620 is a conductive patch and the aperture 610 is an iris that couples the patch antenna element to a guided wave that propagates under the ground body 600 (e.g., where the ground body 600 is the upper conductor of a waveguide such as the substrate-integrated waveguide of FIG. 5). Although this disclosure describes various embodiments that include substantially rectangular conductive patches, this is not intended to be limiting; other conductive patch shapes are contemplated, including bowties, microstrip coils, patches with various slots including interior slots, circular/elliptical/polygonal patches, etc. Moreover, although this disclosure describes various embodiments that include patches situated on a plane above a ground body, this is again not intended to be limiting; other arrangements are contemplated, including, for example: (1) CELC structures, wherein the conducting patch is situated within the aperture 610 and coplanar with the ground body 600; (2) patches that are evanescently coupled to, and coplanar with, a coplanar waveguide; and (3) multiple sub-patch arrangements including multi-layer arrangements with sub-patches situated on two or more planes above the ground body. Moreover, although this disclosure describes various embodiments wherein each scattering element includes a conductor 620 separated from the ground body 600, this is again not intended to be limiting; in other arrangements (e.g. as depicted in FIGS. 6E and 6F, the separate conductor 620 may be omitted; for example, where each scattering element is a CSRR (complementary split-ring resonator) structure that does not define a physically separate conducting island, or where each scattering element is defined by a slot or aperture 610 without a corresponding patch.

The scattering element of FIG. 6A is made adjustable by connecting a two-port lumped element 630 between the conductor 620 and the ground body 600. If the two-port lumped element is nonlinear, a shunt resistance or reactance between the conductor and the ground body can be controlled by adjusting a bias voltage delivered by a bias control line 640. For example, the two-port lumped element can be a varactor diode whose capacitance varies as a function of the applied bias voltage. As another example, the two-port lumped element can be a PIN diode that functions as an RF or microwave switch that is open when reverse biased and closed when forward biased.

In some approaches, the bias control line 640 includes an RF or microwave choke 645 designed to isolate the low frequency bias control signal from the high frequency RF or microwave resonance of the scattering element. The choke can be implemented as another lumped element such as an inductor (as shown). In other approaches, the bias control line may be rendered RF/microwave neutral by means of its length or by the addition of a tuning stub. In yet other approaches, the bias control line may be rendered RF/microwave neutral by adding a resistor or by using a low-conductivity material for the bias control line; examples of low-conductivity materials include indium tin oxide (ITO), polymer-based conductors, a granular graphitic materials, and percolated metal nanowire network materials. In yet other approaches, the bias control line may be rendered RF/microwave neutral by positioning the control line on a node or symmetry axis of the scattering element's radiation mode, e.g. as shown for scattering elements 702 and 703 of FIG. 7A, as discussed below. These various approaches may be combined to further improve the RF/microwave isolation of the bias control line.

While FIG. 6A depicts only a single two-port lumped element 630 connected between the conductor 620 and the ground body 600, other approaches include additional lumped elements that may be connected in series with or parallel to the lumped element 630. For example, multiple iterations of the two-port lumped element 630 may be connected in parallel between the conductor 620 and the ground body 600, e.g. to distribute dissipated power between several lumped elements and/or to arrange the lumped elements symmetrically with respect to the radiation pattern of the resonator (as further discussed below). Alternatively or additionally, passive lumped elements such as inductors and capacitors may be added as additional loads on the patch antenna, thus altering the natural or un-loaded response of the patch antenna. This admits flexibility, for example, in the physical size of the patch in relation to its resonant frequency (as further discussed below in the context of FIGS. 8A-8E). Alternatively or additionally, passive lumped elements may be introduced to cancel, offset, or modify a parasitic package impedance of the active lumped element 630. For example, an inductor or capacitor may be added to cancel a package capacitance or impedance, respectively, of the active lumped element 630 at the resonant frequency of the patch antenna. It is also contemplated that these multiple components per unit cell could be completely integrated into a single packaged integrated circuit, or partially integrated into a set of packaged integrated circuits.

Figure 6B:
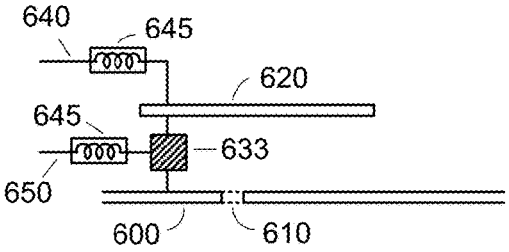

Turning now to FIG. 6B, the scattering element is again generically depicted as a conductor 620 positioned above an aperture 610 in a ground body 600. The scattering element of FIG. 6B is made adjustable by connecting a three-port lumped element 633 between the conductor 620 and the ground body 600, i.e. by connecting a first terminal of the three-port lumped element to the conductor 620 and a second terminal to the ground body 600. Then a shunt resistance or reactance between the conductor 620 and the ground body 600 can be controlled by adjusting a bias voltage on a third terminal of the three-port lumped element 633 (delivered by a bias control line 650) and, optionally, by also adjusting a bias voltage on the conductor 600 (delivered by an optional bias control line 640). For example, the three-port lumped element can be a field-effect transistor (such as a high-electron-mobility transistor (HEMT)) having a source (drain) connected to the conductor 620 and a drain (source) connected to the ground body 600; then the drain-source voltage can be controlled by the bias control line 640 and the gate-drain (gate-source) voltage can be controlled by the bias control line 650. As another example, the three-port lumped element can be a bipolar junction transistor (such as a heterojunction bipolar transistor (HBT)) having a collector (emitter) connected to the conductor 620 and an emitter (collector) connected to the ground body 600; then the emitter-collector voltage can be controlled by the bias control line 640 and the base-emitter (base-collector) voltage can be controlled by the bias control line 650. As yet another example, the three-port lumped element can be a tunable integrated capacitor (such as a tunable BST RF capacitor) having first and second RF terminals connected to the conductor 620 and the ground body 600; then the shunt capacitance can be controlled by the bias control line 650.

As in FIG. 6A, various approaches can be used to isolate the bias control lines 640 and 650 of FIG. 6B so that they do not perturb the RF or microwave resonance of the scattering element. Thus, as similarly discussed above in the context of FIG. 6A, the bias control lines may include RF/microwave chokes or tuning stubs, and/or they may be made of a low-conductivity material, and/or they may be brought into the unit cell along a node or symmetry axis of the unit cell's radiation mode. Note that the bias control line 650 may not need to be isolated if the third port of the three-port lumped element 633 is intrinsically RF/microwave neutral, e.g. if the three-port lumped element has an integrated RF/microwave choke.

While FIG. 6B depicts only a single three-port lumped element 633 connected between the conductor 620 and the ground body 600, other approach include additional lumped elements that may be connected in series with or parallel to the lumped element 630. Thus, as similarly discussed above in the context of FIG. 6A, multiple iterations of the three-port lumped element 633 may be connected in parallel; and/or the passive lumped elements may be added for patch loading or package parasitic offset; and/or these multiple elements may be integrated into a single packaged integrated circuit or a set of packaged integrated circuits.

Figure 6C:
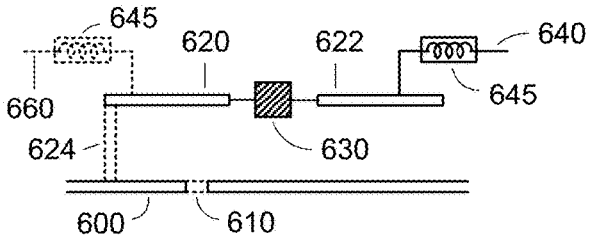
Figure 6D:
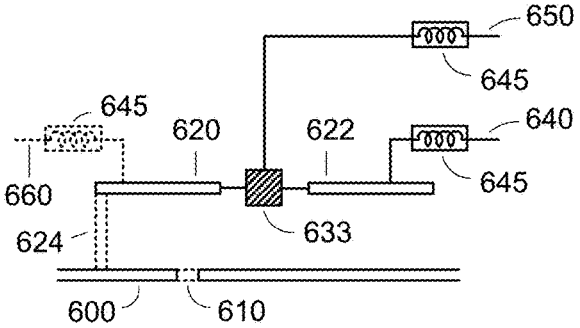
Figure 6E:
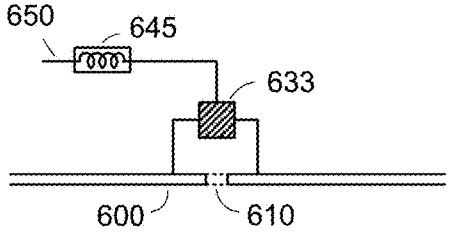
Figure 6F:
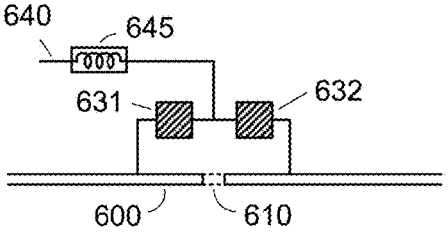

In some approaches, e.g. as depicted in FIGS. 6A and 6B, the scattering element comprises a single conductor 620 above a ground body 600. In other approaches, e.g. as depicted in FIGS. 6C and 6D, the scattering element comprises a plurality of conductors above a ground body. Thus, in FIGS. 6C and 6D, the scattering element is generically depicted as a first conductor 620 and a second conductor 622 positioned above an aperture 610 in a ground body 600. For example, the scattering element may be a multiple-patch antenna having a plurality of sub-patches, in which case the conductors 620 and 622 are first and second sub-patches and the aperture 610 is an iris that couples the multiple-patch antenna to a guided wave that propagates under the ground body 600 (e.g., where the ground body 600 is the upper conductor of a waveguide such as the substrate-integrated waveguide of FIG. 5). One or more of the plurality of sub-patches may be shorted to the ground body, e.g. by an optional short 624 between the first conductor 620 and the ground body 600. This can have the effect of "folding" the patch antenna to reduce the size of the patch antenna in relation to its resonant wavelength, yielding a so-called aperture-fed "PIFA" (Planar Inverted-F Antenna).

With reference now to FIG. 6C, just as the two-port lumped element 630 provides an adjustable shunt impedance in FIG. 6A by virtue of its connection between the conductor 620 and the ground body 600, a two-port lumped element 630 provides an adjustable series impedance in FIG. 6C by virtue of its connection between the first conductor 620 and the second conductor 622. In one approach shown in FIG. 6C, the first conductor 620 is shorted to the ground body 600 by a short 624, and a voltage difference is applied across the two-port lumped element with a bias voltage line 640. In an alternative approach shown in FIG. 6C, the short 624 is absent and a voltage difference is applied across the two-port lumped element 630 with two bias voltage lines 640 and 660.

Noting that a two-port lumped element is depicted in both FIG. 6A and in FIG. 6C, various embodiments contemplated for the shunt scenario of FIG. 6A are also contemplated for the series scenario of FIG. 6C, namely: (1) the two-port lumped elements contemplated above in the context of FIG. 6A as shunt lumped elements are also contemplated in the context of FIG. 6C as series lumped elements; (2) the bias control line isolation approaches contemplated above in the context of FIG. 6A are also contemplated in the context of FIG. 6C; and (3) further lumped elements (connected in series or in parallel with the two-port lumped element 630) contemplated above in the context of FIG. 6A are also contemplated in the context of FIG. 6C.

With reference now to FIG. 6D, just as the three-port lumped element 633 provides an adjustable shunt impedance in FIG. 6B by virtue of its connection between the conductor 620 and the ground body 600, a three-port lumped element 633 provides an adjustable series impedance in FIG. 6D by virtue of its connection between the first conductor 620 and the second conductor 622. A bias voltage is applied to a third terminal of the three-port lumped element with a bias voltage line 650. In one approach shown in FIG. 6D, the first conductor 620 is shorted to the ground body 600 by a short 624, and a voltage difference is applied across first and second terminals of the three-port lumped element with a bias voltage line 640. In an alternative approach shown in FIG. 6D, the short 624 is absent and a voltage difference is applied across first and second terminals of the three-port lumped element with two bias voltage lines 640 and 660.

Noting that a three-port lumped element is depicted in both FIG. 6B and in FIG. 6D, various embodiments contemplated for the shunt scenario of FIG. 6B are also contemplated for the series scenario of FIG. 6D, namely: (1) the three-port lumped elements contemplated above in the context of FIG. 6B as shunt lumped elements are also contemplated in the context of FIG. 6D as series lumped elements; (2) the bias control line isolation approaches contemplated above in the context of FIG. 6B are also contemplated in the context of FIG. 6D; and (3) further lumped elements (connected in series or in parallel with the three-port lumped element 633) contemplated above in the context of FIG. 6B are also contemplated in the context of FIG. 6D.

With reference now to FIGS. 6E and 6F, a scattering element is depicted that omits the conductor 620 of FIGS. 6A-6D; here, the scattering element is simply defined by a slot or aperture 610 in the ground body 600. For example, the scattering element may be a slot on the upper conductor of a waveguide such as a substrate-integrated waveguide or stripline waveguide. As another example, the scattering element may be a CSRR (complementary split ring resonator) defined by an aperture 610 on the upper conductor of such a waveguide. The scattering element of FIG. 6E is made adjustable by connecting a three-port lumped element 633 across the aperture 610 to control the impedance across the aperture. The scattering element of FIG. 6F is made adjustable by connecting two-port lumped elements 631 and 632 in series across the aperture 610, with a bias control line 640 providing a bias between the two-port lumped elements and the ground body. Both passive lumped elements could be tunable nonlinear lumped elements, such as PIN diodes or varactors, or one could be a passive lumped element, such as a blocking capacitor. The bias control line isolation approaches contemplated above in the context of FIGS. 6A-6D are again contemplated here, as are embodiments that include further lumped elements connected in series or in parallel (for example, a single slot could be spanned by multiple lumped elements placed at multiple positions along the length of the slot).

It is to be appreciated that some approaches may include any combination of shunt lumped elements, series lumped elements, and aperture-spanning lumped elements. Thus, embodiments of a scattering element may include one or more of the shunt arrangements contemplated above with respect to FIGS. 6A and 6B, in combination with one or more of the series arrangements contemplated above with respect to FIGS. 6C and 6D, and/or in combination with one or more of the aperture-spanning lumped element arrangements contemplated above with respect to FIGS. 6E and 6F.

FIGS. 7A-7F depict a variety of exemplary physical layouts corresponding to the schematic lumped element arrangements of FIGS. 6A-6F, respectively. The figures depict top views of an individual unit cell or scattering element, and the numbered figure elements depicted in FIGS. 6A-6F are numbered in the same way when they appear in FIGS. 7A-7F.

Figure 7A:
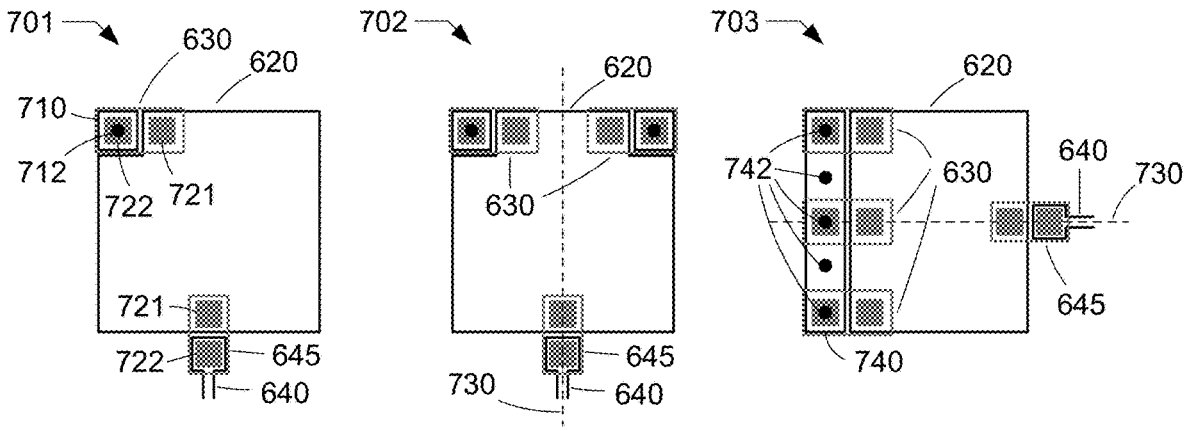
FIGS. 7A-7F depict exemplary physical layouts corresponding to the schematic lumped element arrangements of FIGS. 6A-6F, respectively.

In the exemplary scattering element 701 of FIG. 7A, the conductor 620 is depicted as a rectangle with a notch removed from the corner. The notch admits the placement of a small metal region 710 with a via 712 connecting the metal region 710 to the ground body 600 on an underlying layer (not shown). The purpose of this via structure (metal region 710 and via 712) is to allow for a surface mounting of the lumped element 630, so that the two-port lumped element 630 can be implemented as a surface-mounted component with a first contact 721 that connects the lumped element to the conductor 620 and a second contact 722 that connects to the underlying ground body 600 by way of the via structure 710-712. The bias control line 640 is connected to the conductor 620 through a surface-mounted RF/microwave choke 645 having two contacts 721 and 722 that connect the choke to the conductor 620 and the bias control line 640, respectively.

The exemplary scattering element 702 of FIG. 7A illustrates the concept of deploying multiple iterations of the two-port lumped element 730. Scattering element 702 includes two lumped elements 630 placed on two adjacent corners of the rectangular conductor 620. In addition to reducing the current load on each iteration of the lumped element 730, e.g. to reduce nonlinearity effects or to distribute power dissipation, the multiple lumped elements can be arranged to preserve a geometrical symmetry of the unit cell and/or to preserve a symmetry of the radiation mode of the unit cell. In this example, the two lumped elements 630 are arranged symmetrically with respect to a plane of symmetry 730 of the unit cell. The choke 645 and bias line 640 are also arranged symmetrically with respect to the plane of symmetry 730, because they are positioned on the plane of symmetry. In some approaches, the symmetrically arranged elements 630 are identical lumped elements. In other approaches, the symmetrically arranged elements are non-identical (e.g. one is an active element and the other is a passive element); this may disturb the unit cell symmetry but to a much smaller extent than the solitary lumped element of scattering element 701.

The exemplary scattering element 703 of FIG. 7A illustrates another physical layout consistent with the schematic arrangement of FIG. 6A. In scattering element 703, instead of using a pin-like via structure as in 701 (with a small pinhead 710 capping a single via 712), the element uses an extended wall-like via structure (with a metal strip 740 capping a wall-like colonnade of vias 742). The wall can extend along an entire edge of the rectangular patch 620, as shown, or it can extend along only a portion of the edge. As in 702, the scattering element includes multiple iterations of the two-port lumped element 630, and these iterations are arranged symmetrically with respect to a plane of symmetry 730, as is the choke 645.

Figure 7B:
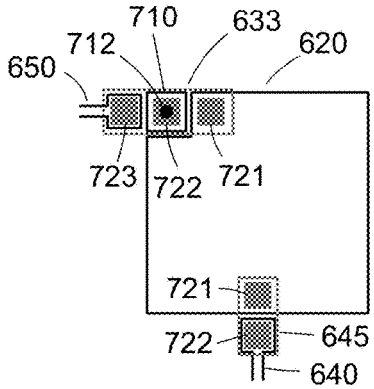

With reference now to FIG. 7B, the figure depicts an exemplary physical layout corresponding to the schematic three-port lumped element shunt arrangement of FIG. 6B. The conductor 620 is depicted as a rectangle with a notch removed from the corner. The notch admits the placement of a small metal region 710 with a via 712 connecting the metal region 710 to the ground body 600 on an underlying layer (not shown). The purpose of this via structure (metal region 710 and via 712) is to allow for a surface mounting of the lumped element 633, so that the three-port lumped element 630 can be implemented as a surface-mounted component with a first contact 721 that connects the lumped element to the conductor 620, a second contact 722 that connects the lumped element to the underlying ground body 600 by way of the via structure 710-712, and a third contact 723 that connects the lumped element to the bias voltage line 650. The optional second bias control line 640 is connected to the conductor 620 through a surface-mounted RF/microwave choke 645 having two contacts 721 and 722 that connect the choke to the conductor 620 and the bias control line 640, respectively. It will be appreciated that multiple three-port elements can be arranged symmetrically in a manner similar to that of scattering element 702 of FIG. 7A, and that the pin-like via structure 710-712 can be replaced with a wall-like via structure in a manner similar to that of scattering element 703 of FIG. 7A.

Figure 7C:
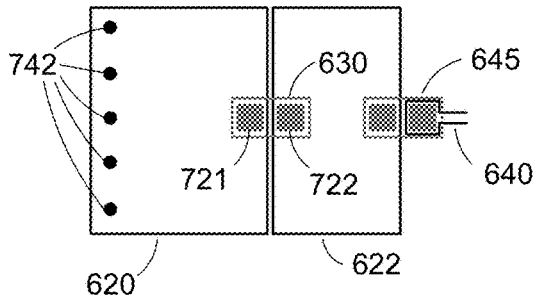

With reference now to FIG. 7C, the figure depicts an exemplary physical layout corresponding to the schematic two-port lumped element series arrangement of FIG. 6C. The short 624 is a wall-like short implemented as a colonnade of vias 742. The two-port lumped element is a surface-mounted component 630 that spans the gap between the first conductor 620 and the second conductor 622, having a first contact 721 that connects the lumped element to the first conductor 620 and a second contact 722 that connects the lumped element to the second conductor 622. The bias control line 640 is connected to the second conductor 622 through a surface-mounted RF/microwave choke 645 having two contacts 721 and 722 that connect the choke to the second conductor 622 and the bias control line 640, respectively. It will again be appreciated that multiple lumped elements can be arranged symmetrically in a manner similar to the arrangements depicted for scattering elements 702 and 703 of FIG. 7A.

Figure 7D:
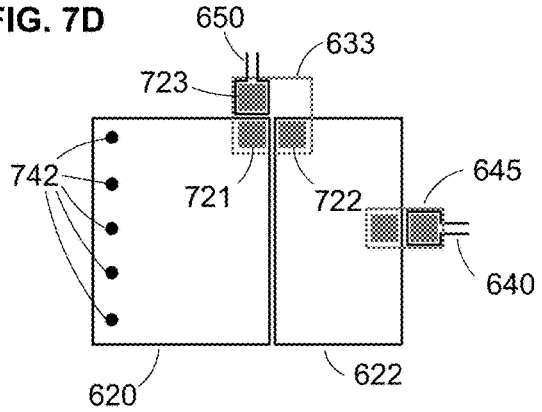

With reference now to FIG. 7D, the figure depicts an exemplary physical layout corresponding to the schematic three-port lumped element series arrangement of FIG. 6D. The short 624 is a wall-like short implemented as a colonnade of vias 742. The three-port lumped element is a surface-mounted component 633 that spans the gap between the first conductor 620 and the second conductor 622, having a first contact 721 that connects the lumped element to the first conductor 620, a second contact 722 that connects the lumped element to the second conductor 622, and a third contact 723 that connects the lumped element to the bias voltage line 650. The optional second bias control line 640 is connected to the second conductor 622 through a surface-mounted RF/microwave choke 645 having two contacts 721 and 722 that connect the choke to the second conductor 622 and the bias control line 640, respectively. It will again be appreciated that multiple lumped elements can be arranged symmetrically in a manner similar to the arrangements depicted for scattering elements 702 and 703 of FIG. 7A.

Figure 7E:
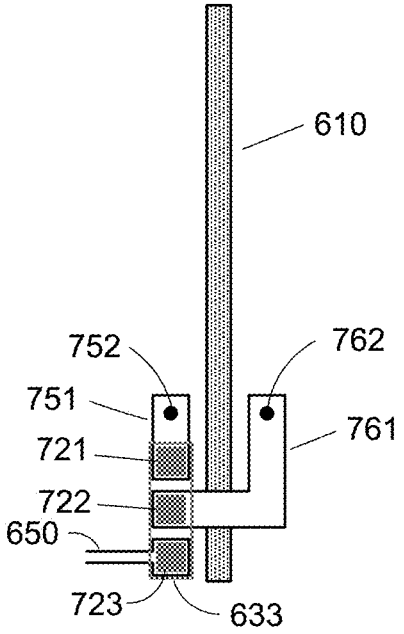

With reference now to FIG. 7E, the figure depicts an exemplary physical layout corresponding to the schematic three-port lumped element arrangement of FIG. 6E. Vias 752 and 762, situated on either side of the slot 610, connect metal regions 751 and 761 (on an upper metal layer) with the ground body 600 (on a lower metal layer). Then the three-port lumped element 633 is implemented as a surface-mounted component with a first contact 721 that connects the lumped element to the first metal region 751, a second contact 722 that connects the lumped element to the second metal region 761, and a third contact 723 that connects the lumped element to the bias control line 650 (on the upper metal layer).

With reference now to FIG. 7E, the figure depicts an exemplary physical layout corresponding to the schematic three-port lumped element arrangement of FIG. 6E. Vias 752 and 762, situated on either side of the slot 610, connect metal regions 751 and 761 (on an upper metal layer) with the ground body 600 (on a lower metal layer). Then the three-port lumped element 633 is implemented as a surface-mounted component with a first contact 721 that connects the lumped element to the first metal region 751, a second contact 722 that connects the lumped element to the second metal region 761, and a third contact 723 that connects the lumped element to the bias control line 650 (on the upper metal layer).

Figure 7F:
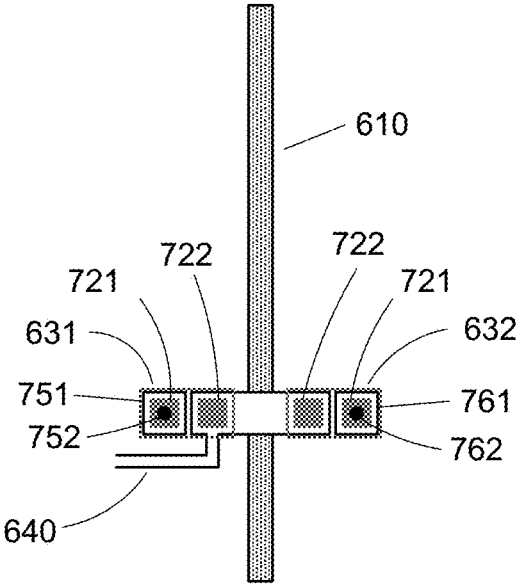

Finally, with reference to FIG. 7F, the figure depicts an exemplary physical layout corresponding to the schematic three-port lumped element arrangement of FIG. 6F. Vias 752 and 762, situated on either side of the slot 610, connect metal regions 751 and 761 (on an upper metal layer) with the ground body 600 (on a lower metal layer). Then the first two-port lumped element 631 is implemented as a surface-mounted component with a first contact 721 that connects the lumped element to the first metal region 751 and a second contact 722 that connects the lumped element to the bias control line 650 (on the upper metal layer); and the second two-port lumped element 632 is implemented as a surface-mounted component with a first contact 721 that connects the lumped element to the second metal region 761 and a second contact 722 that connects the lumped element to the bias control line 650.

Figure 8A:
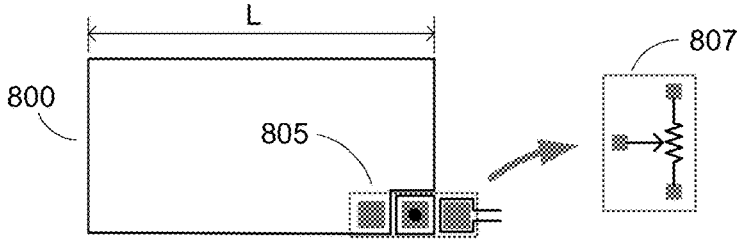
FIGS. 8A-8E depict exemplary physical layouts of patches with lumped elements.
Figure 8B:
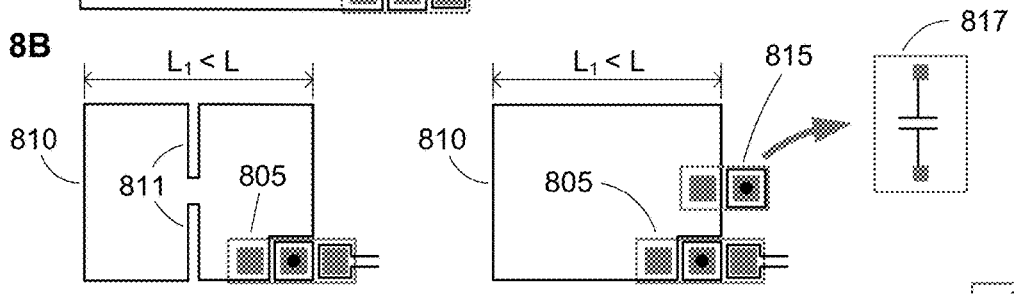
Figure 8C:
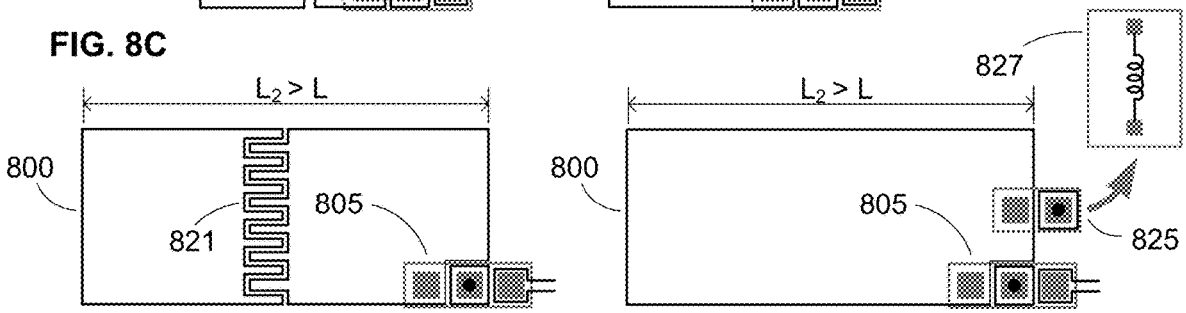
Figure 8D:
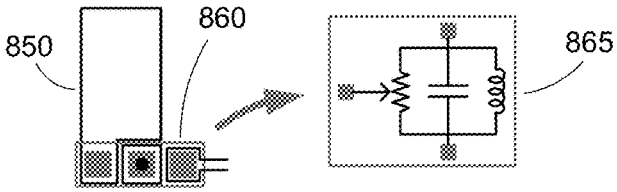
Figure 8E:
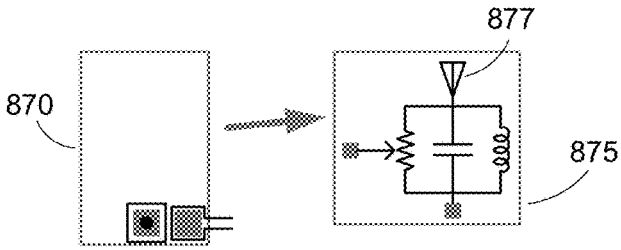

With reference now to FIGS. 8A-8E, the figures depict various examples showing how the addition of lumped elements can admit flexibility regarding the physical geometry of a patch element in relation to its resonant frequency (FIGS. 8D-E also show how the lumped elements can integrate multiple components in a single package). Starting with a rectangular patch 800 of length L in FIG. 8A, the patch can be shortened without altering its resonant frequency by loading the shortened patch 810 with a series inductance or shunt capacitance (FIG. 8B), or the patch can be lengthened without altering its resonant frequency by loading the lengthened patch 820 with a series capacitance or a shunt inductance (FIG. 8C). The patch can be loaded with a series inductance by, for example, adding notches 811 to the patch to create an inductive bottleneck as shown in FIG. 8B, or by spanning two sub-patches with a lumped element inductor (as with the lumped element 630 in FIG. 7C). The patch can be loaded with a shunt capacitance by, for example, adding a lumped element capacitor 815 (with a schematic pinout 817) as shown in FIG. 8B with a via that drops down to a ground plane (as with the lumped element 630 in FIG. 7A). The patch can be loaded with a series capacitance by, for example, interdigitating two sub-patches to create an interdigitated capacitor 821 as shown in FIG. 8C, and/or by spanning two sub-patches with a lumped element capacitor (as with the lumped element 630 in FIG. 7C). And the patch can be loaded with a shunt inductance by, for example, adding a lumped element inductor 825 (with a schematic pinout 827) as shown in FIG. 8C with a via that drops down to a ground plane (as with the lumped element 630 in FIG. 7A). In each of these examples of FIGS. 8A-8C, the patch is rendered tunable by the addition of an adjustable three-port shunt lumped element 805 addressed by a bias voltage line 806 (as with the three-port lumped element 633 in FIG. 7B). The three-port adjustable lumped element 805 has a schematic pinout 807 that depicts the adjustable element as an adjustable resistive element, but an adjustable reactive (capacitive or inductive) element could be substituted.

Recognizing the flexibility regarding the physical geometry of the patch when loaded with lumped elements, FIG. 8D depicts a scattering element in which the resonance behavior is principally determined not by the geometry of a metallic radiator 850, but by the LC resonance of an adjustable tank circuit lumped element 860. In this scenario, the radiator 850 may be substantially smaller than an unloaded patch with the same resonance behavior. The three-port lumped element 860 is a packaged integrated circuit with a schematic pinout 865, here depicted as an RLC circuit with an adjustable resistive element (again, an adjustable reactive (capacitive or inductive) element could be substituted). It is to be noted that the resistance, inductance, and/or capacitance of the lumped element can substantially include, or even be constituted of, parasitics attributable to the lumped element packaging.

In some approaches, the radiative element may itself be integrated with the adjustable tank circuit, so that the entire scattering element is packaged as a lumped element 870 as shown in FIG. 8E. The schematic pinout 875 of this completely integrated scattering element is depicted as an adjustable RLC circuit coupled to an on-chip radiator 877. Again, the resistance, inductance, and/or capacitance of the lumped element can substantially include, or even be constituted of, parasitics attributable to the lumped element packaging.

Figure 9A:
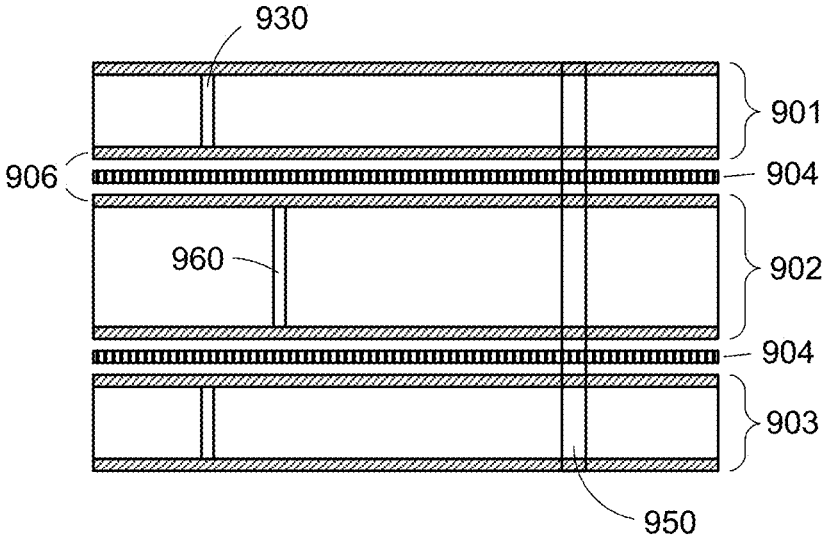
FIGS. 9A-9B depict a first illustrative embodiment of a surface scattering antenna with lumped elements.
Figure 9B:
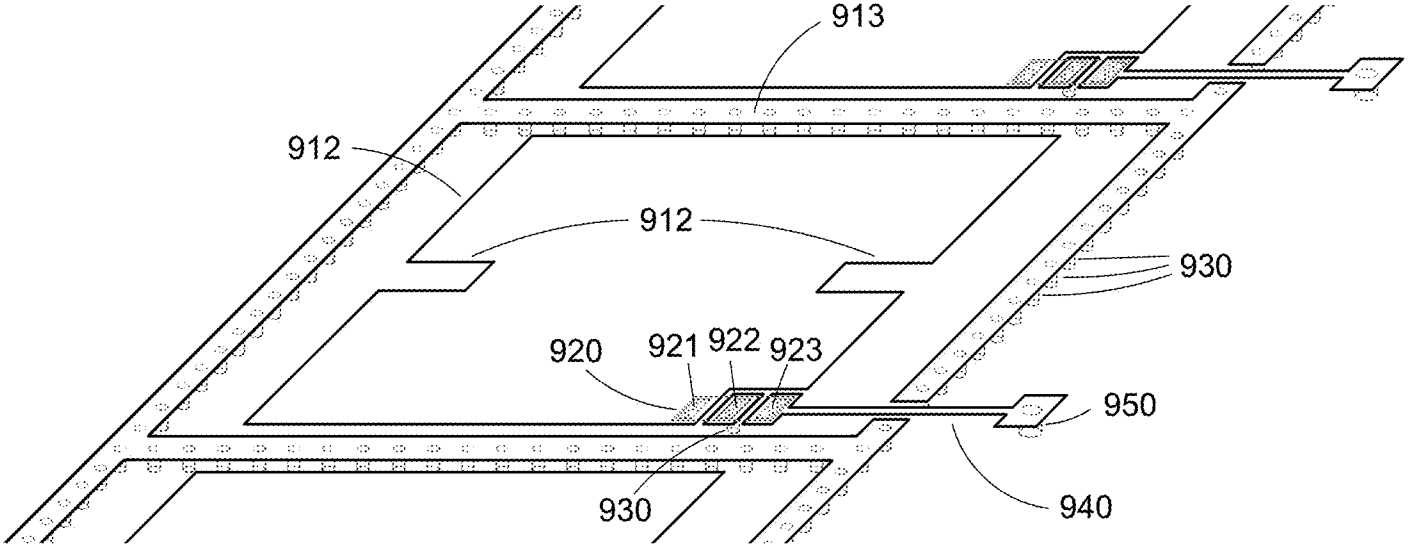

With reference now to FIGS. 9A-9B, a first illustrative embodiment of a surface scattering antenna is depicted. As shown in the side view of FIG. 9A, the illustrative embodiment is a multi-layer PCB assembly including a first double-cladded core 901 implementing the scattering elements, a second double-cladded core 902 implementing a substrate-integrated waveguide such as that depicted in FIG. 5, and a third double-cladded core 903 supporting the bias circuitry for the scattering elements. The multiple cores are joined by layers of prepreg, Bond Ply, or similar bonding material 904. As shown in the top perspective view of FIG. 9B, the scattering elements are implemented as patches 910 positioned above irises (not shown) in the upper conductor 906 of the underlying substrate-integrated waveguide (notice that for ease of fabrication, in this embodiment the upper waveguide conductor 906 is actually a pair of adjacent copper claddings). In this example, each patch 910 includes notches that inductively load the patch. Moreover, each patch is seen to include a via cage 913, i.e. a colonnade of vias that surrounds the unit cell to reduce coupling or crosstalk between adjacent unit cells.

In this illustrative embodiment, each patch 910 includes a three-port lumped element (such as a HEMT) implemented as a surface-mounted component 920 (only the footprint of this component is shown). The configuration is similar to that of FIG. 7B as discussed above: a first contact 921 connects the lumped element to the patch 910; a second contact 922 connects the lumped element to pin-like structure that drops a via (element 930 in the side view of FIG. 9A) down to the waveguide conductor 906; and a third contact 923 connects the lumped element to a bias voltage line 940. The bias voltage line 940 extends beyond the transverse extent of the substrate-integrated via and is then connected by a through-via 950 to bias control circuitry on the opposite side of the multi-layer assembly.

Figure 10:
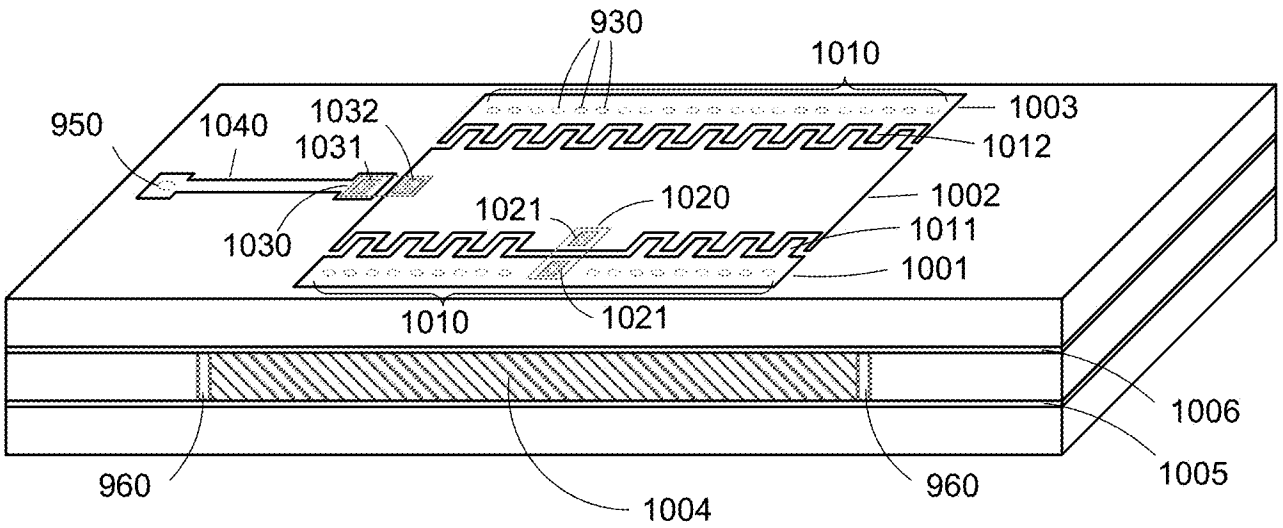
FIG. 10 depicts a second illustrative embodiment of a surface scattering antenna with lumped elements.

With reference now to FIG. 10, a second illustrative embodiment of a surface scattering antenna is depicted. The illustrative embodiment employs the same multi-layer PCB depicted in FIG. 8A, but an alternative patch antenna design with an alternative layout of lumped elements. A substrate integrate waveguide with cross section 1004 is defined by lower conductor 1005, upper conductor 1006, and via walls composed of buried vias 960. The patch antenna includes three sub-patches: the first sub-patch 1001 and the third sub-patch 1003 are shorted to the upper waveguide conductor 1006 by colonnades 1010 of blind vias 930; the second sub-patch 1002 is capacitively-coupled to the first and second sub-patches by first and second interdigitated capacitors 1011 and 1012. The patch includes a tunable two-port element (such as a varactor diode) implemented as a surface-mounted component 1020 (only the footprint of this component is shown). The configuration is similar to that of FIG. 7C as discussed above: a first contact 1021 connects the lumped element to the first sub-patch 1001, and a second contact 1022 connects the lumped element to the second sub-patch 1002, so that the lumped element spans the first interdigitated capacitor 1011. A bias control line 1040 is connected to the second sub-patch 1002 through a surface-mounted RF/microwave choke 1030 having two contacts 1031 and 1032 that connect the choke to the second sub-patch 1002 and the bias control line 1040, respectively. As in the first illustrative embodiment, the bias voltage line 1040 extends beyond the transverse extent of the substrate-integrated waveguide and is then connected by a through-via 950 to bias control circuitry on the opposite side of the multi-layer assembly.

Figure 11A:
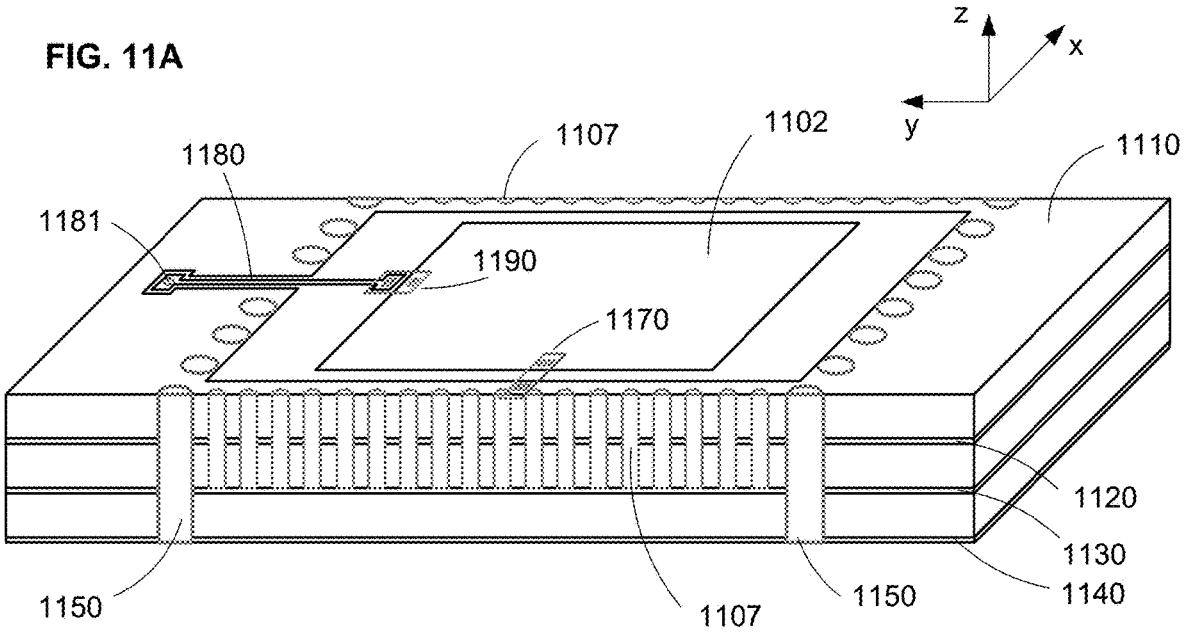
FIGS. 11A-11B depict a third illustrative embodiment of a surface scattering antenna with lumped elements.
Figure 11B:
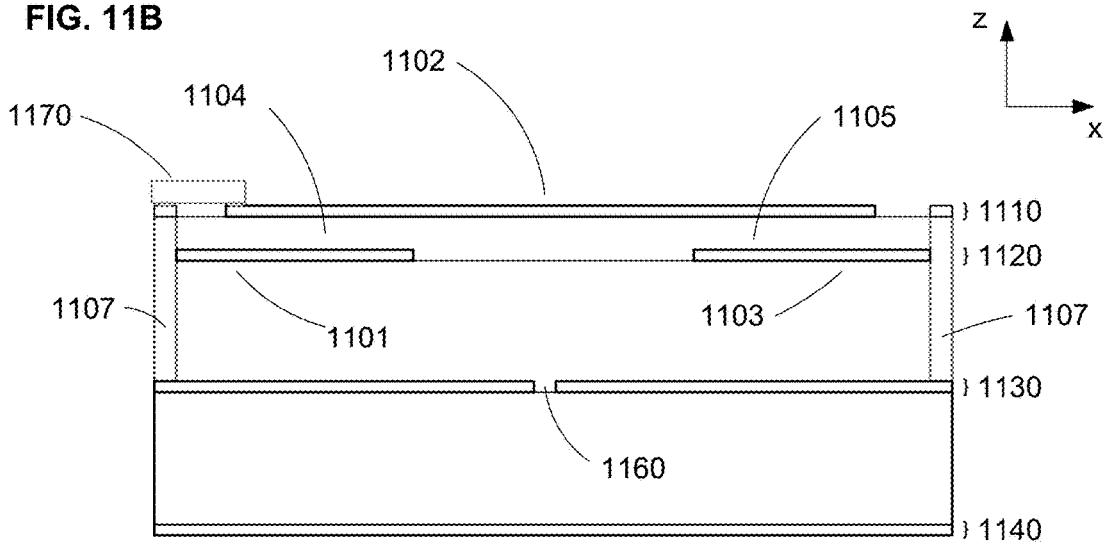

With reference now to FIGS. 11A-11B, a third illustrative embodiment of a surface scattering antenna is depicted. FIG. 11A shows a perspective view, while FIG. 11B shows a cross section through the center of a unit cell along the x-z plane. In this embodiment, each unit cell includes a patch element with three sub-patches 1101, 1102, and 1103, as in FIG. 10, but the sub-patches are not coplanar. The middle sub-patch 1102 resides on a first metal layer 1110 of the PCB assembly, while the left and right sub-patches 1101 and 1102 reside on a second metal layer 1120. The sub-patches are capacitively coupled by parallel-plate capacitive overlaps 1104 and 1105 in lieu of the interdigitated capacitors of FIG. 10. A substrate-integrated waveguide is defined by third and fourth metal layers 1130 and 1140 and by collonades of vias 1150, with an aperture 1160 coupling the patch to the waveguide. The left sub-patch 1101 and the right sub-patch 1103 are shorted to the upper waveguide conductor 1130 by colonnades of vias 1107. The patch includes a tunable two-port element (such as a varactor diode) implemented as a surface-mounted component 1170 (only the footprint of the component is shown). The configuration is similar to that of FIG. 7C as discussed above: a first contact connects the lumped element to the left sub-patch 1101, and a second contact connects the lumped element to the middle sub-patch 1102, so that the lumped element is connected in parallel with the parallel-plate capacitance 1104. A bias control line 1180 is connected to the middle sub-patch 1102 through a surface-mounted RF/microwave choke 1190 having two contacts that connect the choke to the second sub-patch 1102 and the bias control line 1180. As in the first and second illustrative embodiment, the bias voltage line 1180 extends beyond the transverse extent of the substrate-integrated waveguide and is then connected by a through-via 1181 to bias control circuitry on the opposite side of the multi-layer assembly (not shown).

Figure 12A:
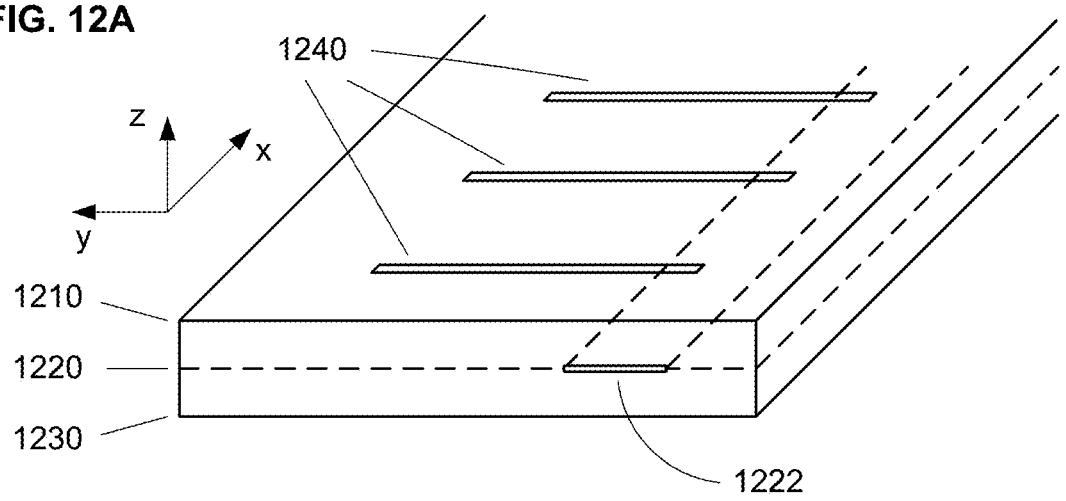
FIGS. 12A-12B depict a fourth illustrative embodiment of a surface scattering antenna with lumped elements.
Figure 12B:
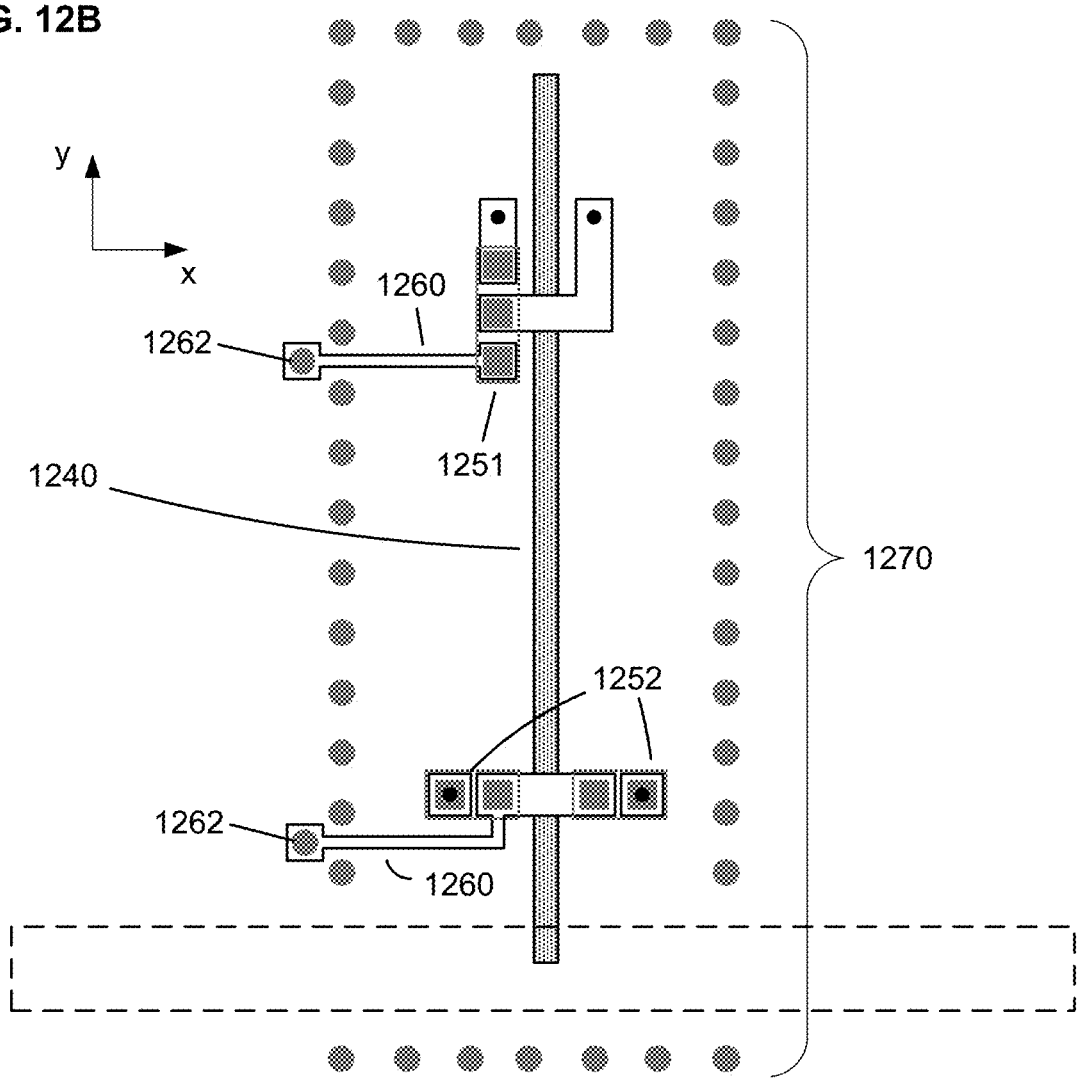

With reference now to FIGS. 12A-12B, a fourth illustrative embodiment of a surface scattering antenna is depicted. In this embodiment, the waveguide is a stripline structure having an upper conductor 1210, a middle conductor layer 1220 providing the stripline 1222, and a lower conductor layer 1230. The scattering elements are a series of slots 1240 in the upper conductor, and the impedances of these slots are controlled with lumped elements arranged as in FIGS. 6E, 6F, 7E, and 7F. An exemplary top view of a unit cell is depicted in FIG. 12B. In this example, lumped elements 1251 and 1252 are arranged to span the upper and lower ends of the slot, respectively, with bias control lines 1260 on the top layer of the assembly connected by through vias 1262 to bias control circuitry on the bottom layer of the assembly (not shown). In this example, the upper lumped element 1251 is a three-port lumped element as in FIG. 7E, while the lower lumped elements 1252 are two-port lumped elements as in FIG. 7F. Each unit cell optionally includes a via cage 1270 to define a cavity-backed slot structure fed by the stripline as it passes through successive unit cells.

Figure 13:
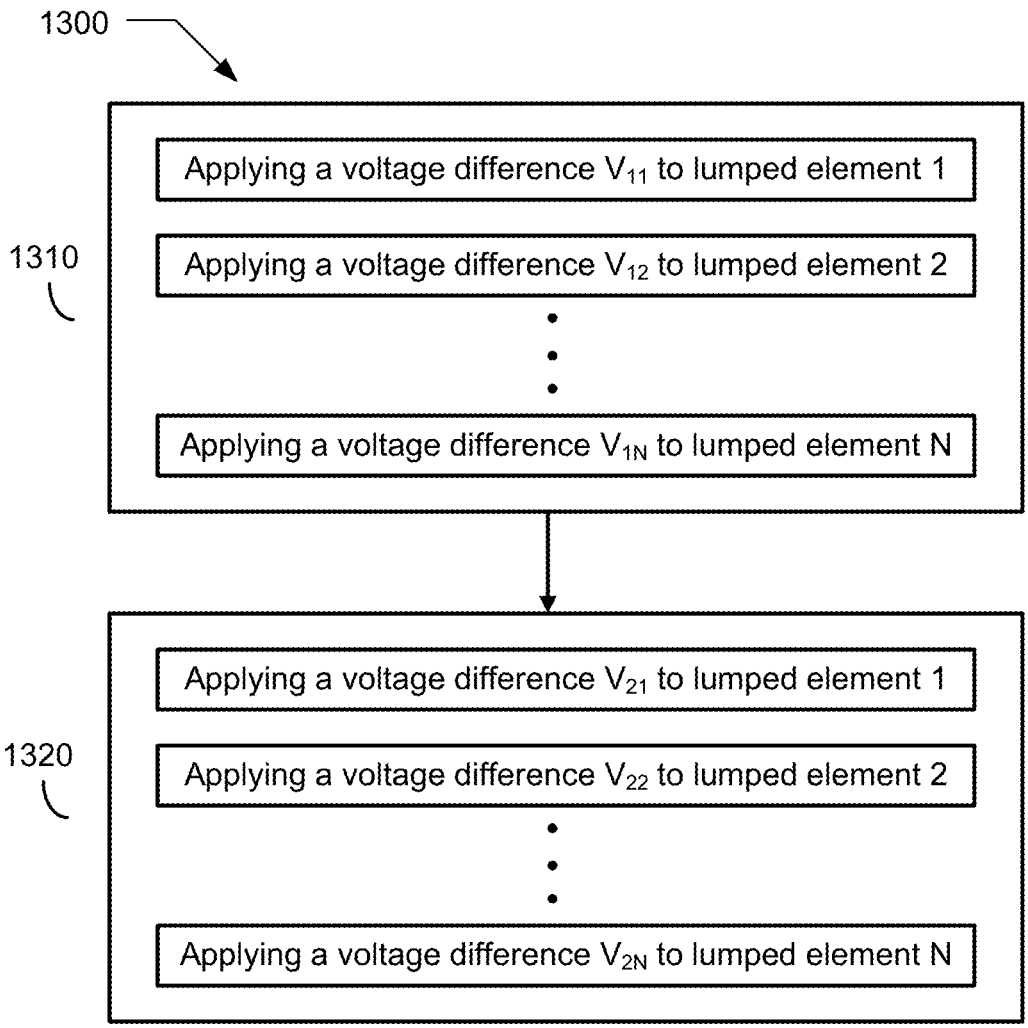
FIG. 13 depicts a flow diagram.

With reference now to FIG. 13, an illustrative embodiment is depicted as a process flow diagram. The process 1300 includes a first step 1310 that involves applying first voltage differences $\{V_{11}, V_{12}, \ldots, V_{1N}\}$ to N lumped elements, and a second step 1320 that involves applying second voltage differences $\{V_{21}, V_{22}, \ldots, V_{2N}\}$ to the N lumped elements. For example, for a surface scattering antenna that includes N unit cells, with each unit cell containing a single adjustable lumped element, the process configures the antenna in a first configuration corresponding to the first voltage differences $\{V_{11}, V_{12}, \ldots, V_{1N}\}$, and then the process reconfigures the antenna in a second configuration corresponding to the second voltages differences $\{V_{11}, V_{12}, \ldots, V_{1N}\}$. The voltage differences can include, for example, voltage differences across two-port elements 630 such as those depicted in FIGS. 6A, 6C, 6F, 7A, 7C, and 7F, and/or voltage differences across pairs of terminals of three-port elements 633 such as those depicted in FIGS. 6B, 6D, 6E, 7B, 7D, and 7E.

In some approaches, each scattering element of the antenna may be adjusted in a binary fashion. For example, the first voltage difference may correspond to an "on" state of a unit cell, while a second voltage difference may correspond to an "off" state of a unit cell. Thus, if each lumped element is a diode, two alternative voltage differences might be applied to the diode, corresponding to reverse-bias and forward-bias modes of the diode; if each lumped element is a transistor, two alternative voltage differences might be applied between a gate and source of the transistor or between a gate and drain of the transistor, corresponding to pinch-off and ohmic modes of the transistor.

In other approaches, each scattering element of the antenna may be adjusted in a grayscale fashion. For example, the first and second voltage differences may be selected from a set of voltages differences corresponding to a set of graduated radiative responses of the unit cell. Thus, if each lumped element is a diode, a set of alternative voltage differences might be applied to the diode, corresponding to a set of reverse bias modes of the diode (as with a varactor diode whose capacitance varies with the extent of its depletion zone); if each lumped element is a transistor, a set of alternative voltage differences might be applied between a gate and source of the transistor or between a gate and drain of the transistor, corresponding to a set of different ohmic modes of the transistor (or a pinch-off mode and a set of ohmic modes).

A grayscale approach may also be implemented by providing each unit cell with a set of lumped elements and a corresponding set of voltage differences. Each lumped element of the unit cell may be independently adjusted, and the "grayscales" are then a group of graduated radiative responses of the unit cell corresponding to a group of voltage difference sets.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. In one embodiment, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and or firmware would be well within the skill of one of skill in the art in light of this disclosure. In addition, those skilled in the art will appreciate that the mechanisms of the subject matter described herein are capable of being distributed as a program product in a variety of forms, and that an illustrative embodiment of the subject matter described herein applies regardless of the particular type of signal bearing medium used to actually carry out the distribution. Examples of a signal bearing medium include, but are not limited to, the following: a recordable type medium such as a floppy disk, a hard disk drive, a Compact Disc (CD), a Digital Video Disk (DVD), a digital tape, a computer memory, etc.; and a transmission type medium such as a digital and/or an analog communication medium (e.g., a fiber optic cable, a waveguide, a wired communications link, a wireless communication link, etc.).

In a general sense, those skilled in the art will recognize that the various aspects described herein which can be implemented, individually and/or collectively, by a wide range of hardware, software, firmware, or any combination thereof can be viewed as being composed of various types of "electrical circuitry." Consequently, as used herein "electrical circuitry" includes, but is not limited to, electrical circuitry having at least one discrete electrical circuit, electrical circuitry having at least one integrated circuit, electrical circuitry having at least one application specific integrated circuit, electrical circuitry forming a general purpose computing device configured by a computer program (e.g., a general purpose computer configured by a computer program which at least partially carries out processes and/or devices described herein, or a microprocessor configured by a computer program which at least partially carries out processes and/or devices described herein), electrical circuitry forming a memory device (e.g., forms of random access memory), and/or electrical circuitry forming a communications device (e.g., a modem, communications switch, or optical-electrical equipment). Those having skill in the art will recognize that the subject matter described herein may be implemented in an analog or digital fashion or some combination thereof.

All of the above U.S. patents, U.S. patent application publications, U.S. patent applications, foreign patents, foreign patent applications and non-patent publications referred to in this specification and/or listed in any Application Data Sheet, are incorporated herein by reference, to the extent not inconsistent herewith.

One skilled in the art will recognize that the herein described components (e.g., steps), devices, and objects and the discussion accompanying them are used as examples for the sake of conceptual clarity and that various configuration modifications are within the skill of those in the art. Consequently, as used herein, the specific exemplars set forth and the accompanying discussion are intended to be representative of their more general classes. In general, use of any specific exemplar herein is also intended to be representative of its class, and the non-inclusion of such specific components (e.g., steps), devices, and objects herein should not be taken as indicating that limitation is desired.

With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. Furthermore, it is to be understood that the invention is defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

With respect to the appended claims, those skilled in the art will appreciate that recited operations therein may generally be performed in any order. Examples of such alternate orderings may include overlapping, interleaved, interrupted, reordered, incremental, preparatory, supplemental, simultaneous, reverse, or other variant orderings, unless context dictates otherwise. With respect to context, even terms like "responsive to," "related to," or other past-tense adjectives are generally not intended to exclude such variants, unless context dictates otherwise.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A multi-layer assembly, comprising:

a waveguide;

a plurality of antenna elements coupled to the waveguide; and a plurality of surface-mount components positioned on an upper surface of the multi-layer assembly and configured to adjust radiation characteristics of the antenna elements;

wherein the waveguide is a substrate-integrated waveguide;

wherein the substrate-integrated waveguide includes a dielectric substrate defining an interior of the waveguide, a first conducting surface above the substrate defining a ceiling of the waveguide, a second conducting surface below the substrate defining a floor of the waveguide, and one or more colonnades of vias between the first conducting surface and the second conducting surface defining the walls of the waveguide;

wherein the dielectric substrate is a first printed circuit board laminate, the first conducting surface is a portion of a first metal cladding on an upper side of the first printed circuit board laminate, and the second conducting surface is a portion of second metal cladding on a lower side of the first printed circuit board laminate;

wherein the plurality of antenna elements is a plurality of unit cells each containing one or more patches of a third metal cladding on an upper side of a second printed circuit board laminate, and the second printed circuit board laminate is adhered to the upper side of the first printed circuit board laminate;

wherein the first metal cladding includes, for each of the plurality of unit cells, an aperture positioned under the one or more patches of the third metal cladding; and wherein a lower side of the second printed circuit board laminate has a fourth metal cladding that includes, for each of the plurality of unit cells, an aperture coinciding with the aperture in the first metal cladding.

2. The assembly of claim 1, wherein the plurality of surface-mount components includes, for each of the plurality of unit cells:

a first two-terminal surface-mount component having a first contact that connects to a patch selected from the one or more patches and a second contact that connects to the fourth metal cladding by a via through the second printed circuit board laminate.

3. The assembly of claim 2, wherein the first two-terminal surface-mount component is a diode.

4. The assembly of claim 2, wherein the plurality of surface-mount components further includes, for each of the plurality of unit cells:

a second two-terminal surface-mount component having a first contact that connects to the patch selected from the one or more patches and a second contact that connects to a bias voltage line defined as a portion of the third metal cladding.

5. The assembly of claim 4, wherein the second two-terminal surface-mount component is an RF or microwave choke.

6. The assembly of claim 4, wherein the assembly further includes:

a third printed circuit board laminate adhered to the lower side of the first metal printed circuit board laminate; and for each of the plurality of unit cells, a through via that connects the bias voltage line to a fifth metal cladding on a lower side of the third printed circuit board.

7. The assembly of claim 1, wherein the plurality of surface-mount components includes, for each of the plurality of unit cells:

a three-terminal surface-mount component having a first contact that connects to a patch selected from the one or more patches, a second contact that connects to the fourth metal cladding by a via through the second printed circuit board laminate, and a third contact that connects to a bias voltage line defined as a portion of the third metal cladding.

8. The assembly of claim 7, wherein the plurality of surface-mount components further includes, for each of the plurality of unit cells:

a two-terminal surface-mount component having a first contact that connects to the patch selected from the one or more patches and a second contact that connects to a bias voltage line defined as a portion of the third metal cladding.

9. The assembly of claim 8, wherein the second two-terminal surface-mount component is an RF or microwave choke.

10. The assembly of claim 8, wherein the assembly further includes:

a third printed circuit board laminate adhered to the lower side of the first metal printed circuit board laminate; and for each of the plurality of unit cells, a through via that connects the bias voltage line to a fifth metal cladding on a lower side of the third printed circuit board.

* * * * *